US009206021B2

(12) United States Patent
Kurotsu et al.

(10) Patent No.: US 9,206,021 B2
(45) Date of Patent: Dec. 8, 2015

(54) CRANE AND CRANE ASSEMBLING METHOD

(71) Applicant: KOBELCO CRANES CO., LTD., Shinagawa-ku (JP)

(72) Inventors: Hitoshi Kurotsu, Akashi (JP); Teppei Maedo, Akashi (JP); Eiji Miya, Akashi (JP); Keiko Inada, Akashi (JP)

(73) Assignee: KOBELCO CRANES CO., LTD., Shinagawa-ku (JP)

( * ) Notice: Subject to any disclaimer, the term of this patent is extended or adjusted under 35 U.S.C. 154(b) by 155 days.

(21) Appl. No.: 14/032,504

(22) Filed: Sep. 20, 2013

(65) Prior Publication Data

US 2014/0083964 A1 Mar. 27, 2014

(30) Foreign Application Priority Data

Sep. 26, 2012 (JP) ..... 2012-211945
Sep. 26, 2012 (JP) ..... 2012-211946

(51) Int. Cl.

*B66C 23/42* (2006.01)
*B66C 23/68* (2006.01)
*B66C 23/66* (2006.01)
*B66C 23/82* (2006.01)

(52) U.S. Cl.

CPC ..... *B66C 23/68* (2013.01); *B66C 23/66* (2013.01); *B66C 23/82* (2013.01); *Y10T 29/49826* (2015.01)

(58) Field of Classification Search

CPC ..... B66C 23/26; B66C 23/42; B66C 23/66; B66C 23/68; B66C 23/70; B66C 23/344; B66C 23/346; B66C 23/365; B66C 23/3653; B66C 23/06

See application file for complete search history.

(56) References Cited

U.S. PATENT DOCUMENTS 2,371,261 A * 3/1945 Peterson ..... 212/301
2,529,454 A * 11/1950 Marcantonio ..... 212/300
2,741,373 A * 4/1956 Edgar ..... 212/302
3,306,470 A * 2/1967 Green et al. ..... 212/300
3,732,988 A * 5/1973 Lamer ..... 212/300
3,747,957 A * 7/1973 Noll ..... 280/404
3,794,184 A * 2/1974 Higgins ..... 212/295
3,912,088 A * 10/1975 Bronfman ..... 212/274
3,968,884 A * 7/1976 Johnson et al. ..... 212/300

(Continued)

FOREIGN PATENT DOCUMENTS

CN 101423179 A 5/2009
EP 0 132 892 A1 2/1985

(Continued)

*Primary Examiner* — Emmanuel M Marcelo
*Assistant Examiner* — Michael Gallion
(74) *Attorney, Agent, or Firm* — Oblon, McClelland, Maier & Neustadt, L.L.P.

(57) ABSTRACT

Provided is a crane which comprises a luffing jib including a lower jib and an upper jib coupled to the lower jib in such a manner as to be separable from the lower jib, the lower jib is attached to a head of a boom to have a laid-down posture at a position between the boom and a strut when the upper jib is separated from the lower jib, when the boom is lowered and laid down to allow the head of the boom to come into contact with a ground and when the strut is lowered and laid down to allow a distal end of the strut to come into contact with the ground, and the lower jib has a length which causes no interference with the strut when the lower jib has the laid-down posture at the position between the boom and the strut.

8 Claims, 14 Drawing Sheets

(56) References Cited

U.S. PATENT DOCUMENTS

| | | | | |
|---|---|---|---|---|
| 4,491,229 | A * | 1/1985 | Behrendt et al. | 212/270 |
| 4,529,094 | A | 7/1985 | Wadsworth | |
| 5,480,041 | A * | 1/1996 | Turner | 212/273 |
| 5,842,587 | A * | 12/1998 | Wanek et al. | 212/177 |
| 6,039,194 | A * | 3/2000 | Beeche et al. | 212/301 |
| 7,341,158 | B2 * | 3/2008 | Toudou et al. | 212/262 |
| 7,878,346 | B1 * | 2/2011 | Watts et al. | 212/168 |
| 8,684,197 | B2 * | 4/2014 | Pech et al. | 212/260 |
| 8,739,987 | B2 * | 6/2014 | Martin et al. | 212/177 |
| 8,839,966 | B2 * | 9/2014 | Walker et al. | 212/177 |
| 2004/0000531 | A1 | 1/2004 | Willim | |
| 2006/0065616 | A1 * | 3/2006 | Diehl | 212/300 |
| 2008/0116161 | A1 | 5/2008 | Kurotsu et al. | |
| 2008/0264887 | A1 * | 10/2008 | Porubcansky | 212/198 |
| 2009/0127219 | A1 * | 5/2009 | Willim | 212/300 |
| 2009/0139948 | A1 * | 6/2009 | Holly et al. | 212/292 |
| 2010/0072156 | A1 * | 3/2010 | Mentink et al. | 212/196 |
| 2010/0213152 | A1 * | 8/2010 | Martin et al. | 212/177 |
| 2010/0276385 | A1 * | 11/2010 | Pech et al. | 212/237 |
| 2011/0233165 | A1 | 9/2011 | Holly et al. | |
| 2014/0263140 | A1 * | 9/2014 | Inada et al. | 212/177 |
| 2014/0346132 | A1 * | 11/2014 | Seki et al. | 212/349 |

FOREIGN PATENT DOCUMENTS

| | | |
|---|---|---|
| JP | 4-33717 | 6/1992 |
| JP | 5-186185 A | 7/1993 |
| JP | 10-7388 A | 1/1998 |
| JP | 2004-75294 | 3/2004 |
| JP | 3554583 B2 | 5/2004 |
| JP | 2008-127150 | 6/2008 |
| JP | 2009-149438 | 7/2009 |
| JP | 4613897 | 10/2010 |
| JP | 2010-285233 A | 12/2010 |
| JP | 2012-162344 | 8/2012 |

* cited by examiner

CRANE AND CRANE ASSEMBLING METHOD

BACKGROUND OF THE INVENTION

1. Field of the Invention

The present invention relates to a crane, and a crane assembling method.

2. Background Art

Heretofore, there has been known a crane which comprises: a boom; a luffing jib (hereinafter referred to simply as "jib") attached to the boom in a raisable and lowerable manner; and a strut attached to the boom in a raisable and lowerable manner, to raise and lower the jib. This type of crane is disclosed, for example, in JP 2004-75294A, JP 4613897B and JP 04-033717B.

A method of attaching a jib to a boom includes an extending-type attaching method and an enfolding-type attaching method. In the extending-type attaching method, a jib is laid in front of a boom which is lowered and laid down, and, in this state, the jib is attached to the boom, as described, for example, in FIGS. 1 to 4 of the JP 2004-75294A. In the enfolding-type attaching method, a jib is laid under a boom which is lowered and laid down, and hoisted up, and, in this state, the jib is attached to the boom, as described, for example, in FIGS. 9 and 10 of the JP 4613897B. As compared to the enfolding-type attaching method, the extending-type attaching method facilitates assembling of a jib, although there is a need for a larger assembling space. As compared to the extending-type attaching method, the enfolding-type attaching method has more difficulty in performing an operation of attaching a jib to a boom. That is, in the enfolding-type attaching method, assemblability of a jib becomes poor. On the other hand, the enfolding-type attaching method needs less assembling space. Meanwhile, the enfolding-type attaching method includes an enfolding support-type attaching method described on FIGS. 3 to 7 of the JP 04-033717B, and a jib foot offset-type attaching method in which a jib foot is disposed at a position largely offset from a central axis of a boom.

A method of attaching a strut and a jib to a boom includes the following two processes. One is a process I in which the strut is attached to the boom, and then the jib is attached to the boom, and the other is a process II in which the jib is attached to the boom, and then the strut is attached to the boom. In the case where the process I is employed in the extending-type attaching method, an operation of attaching the jib to the boom has to be performed under the strut, so that assemblability of the jib becomes poor. In the case where the process I is employed in the enfolding-type attaching method, when the boom is positionally adjusted with respect to the jib placed on the ground (see, for example, FIG. 8 of the JP 4613897B), the boom has to be turned in a state in which the strut is attached thereto, so that it needs to take a long time for the position adjustment. As a result, assemblability of the jib becomes poor. On the other hand, in the case where the process II is employed in the extending-type attaching method, after attaching the jib to the boom, the strut is assembled above the jib, so that an assembling operation of the strut at a distal end of the boom has to be performed in high places, and thereby assemblability of the strut becomes poor. In the case where the process II is employed in the enfolding-type attaching method, a head of the boom cannot be placed in contact with the ground, so that the assembling operation of the strut at the distal end of the boom has to be performed in higher places, and thereby assemblability of the strut becomes poor.

As above, various methods have been employed in conventional cranes to attach a jib and a strut to a boom. However, each of the attaching methods has a problem with assemblability of the jib or strut.

SUMMARY OF THE INVENTION

It is an object of the present invention to improve assemblability of a jib and a strut of a crane.

According to one aspect of the present invention, there is provided a crane which comprises: a crane body; a boom attached to the crane body in a raisable and lowerable manner; a luffing jib attached to a head of the boom in a raisable and lowerable manner; and a strut attached to the head of the boom in a raisable and lowerable manner, to raise and lower the luffing jib. The luffing jib comprises: a lower jib making up a first portion of the luffing jib, the first portion extending over a specific range from a base end of the luffing jib toward a tip of the luffing jib, wherein the lower jib is attached to the head of the boom in a raisable and lowerable manner, at a position located below an attaching position of a base end of the strut to the head of the boom in a state in which the boom is lowered and laid down; and an upper jib making up a second portion of the luffing jib, the second portion positioned between the tip of the luffing jib and the lower jib, wherein the upper jib is coupled to the lower jib in such a manner as to be separable from the lower jib. The lower jib is attached to the head of the boom to have a laid-down posture at a position at a position between the boom and the strut when the upper jib is separated from the lower jib, when the boom is lowered and laid down to allow the head of the boom to come into contact with the ground and when the strut is lowered and laid down to allow a distal end of the strut to come into contact with the ground. The lower jib has a length which causes no interference with the strut when the lower jib has the laid-down posture at the position between the boom and the strut.

DETAILED DESCRIPTION OF THE EMBODIMENTS OF THE INVENTION

With reference to FIGS. 1 to 11, a crane 1 equipped with a lower jib 40, according to one embodiment of the present invention, will be described.

Figure 1:
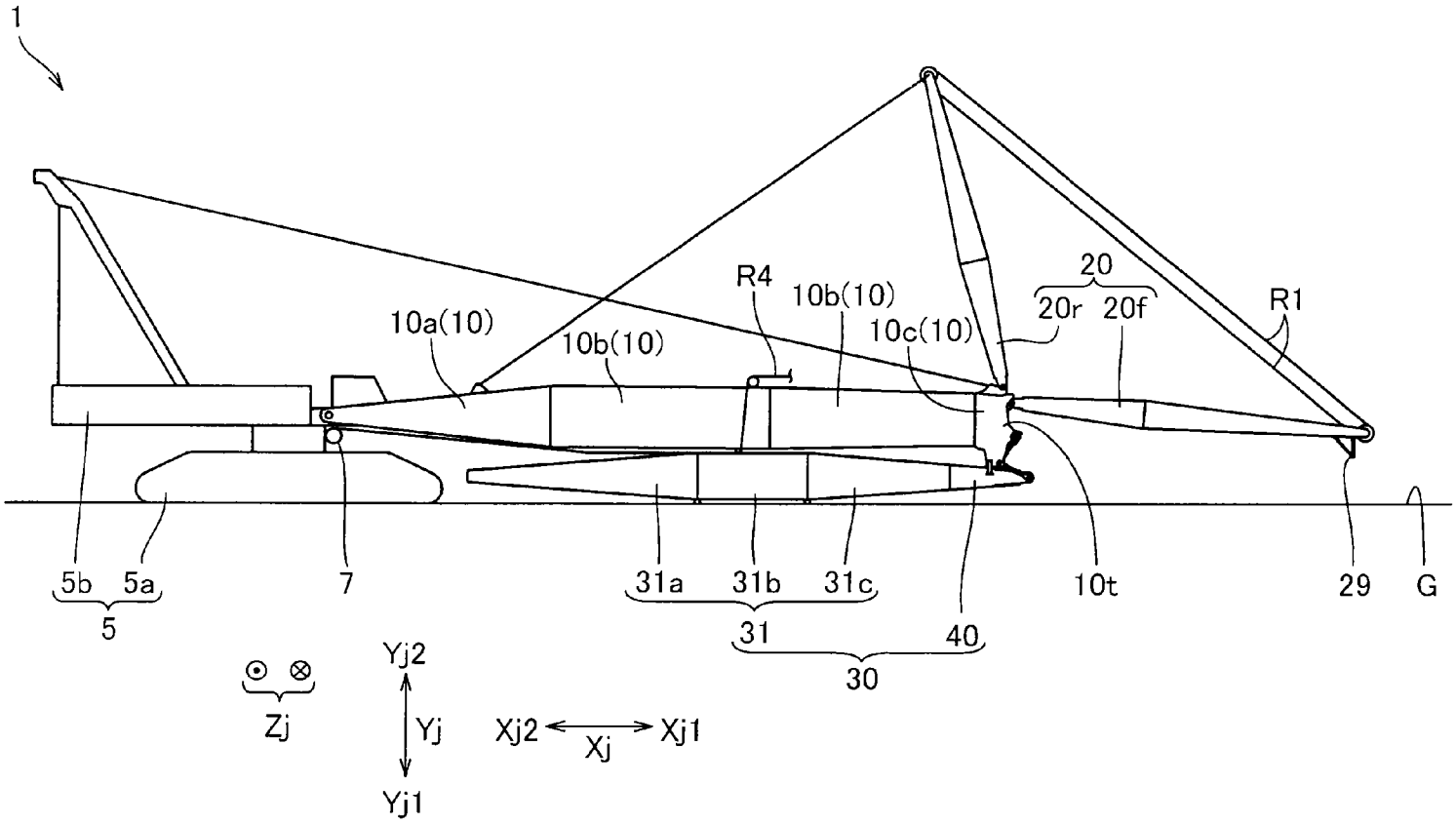
FIG. 1 is an overall view of a crane in a jib assembling state, when viewed in a lateral direction.

As illustrated in FIG. 1, the crane 1 is a construction machine equipped with a boom 10, etc. For example, the crane 1 may be a crawler crane equipped with a lattice boom. The crane 1 comprises a crane body 5, a boom 10 attached to the crane body 5, and a strut 20 and a jib 30 (lulling jib) each attached to the boom 10.

The crane body 5 comprises a lower body 5*a* and an upper slewing body 5*b* attached to the lower body 5*a* in a slewable manner, and is provided with a reeving winch 7. For example, the lower body 5*a* may be a self-propelled type, i.e., a lower propelling body. In this case, the lower body 5*a* may be a crawler type, or may be a wheel type.

The reeving winch 7 is a winch for winding and unwinding a reeving rope R4. The reeving winch 7 is attached to the crane body 5. Specifically, the reeving winch 7 is attached to a front end of the crane body 5, for example, a front end of the upper slewing body 5*b*. Alternatively, the reeving winch 7 may be attached to a front end of the lower body 5*a*. The reeving rope R4 is a rope for assisting in wrapping a wire rope (not illustrated) or the like for suspending a load from the boom 10 and/or a jib 30, around the boom 10 and others. The reeving rope R4 has a diameter smaller than a diameter of the wire rope, and is easy to handle.

Figure 2:
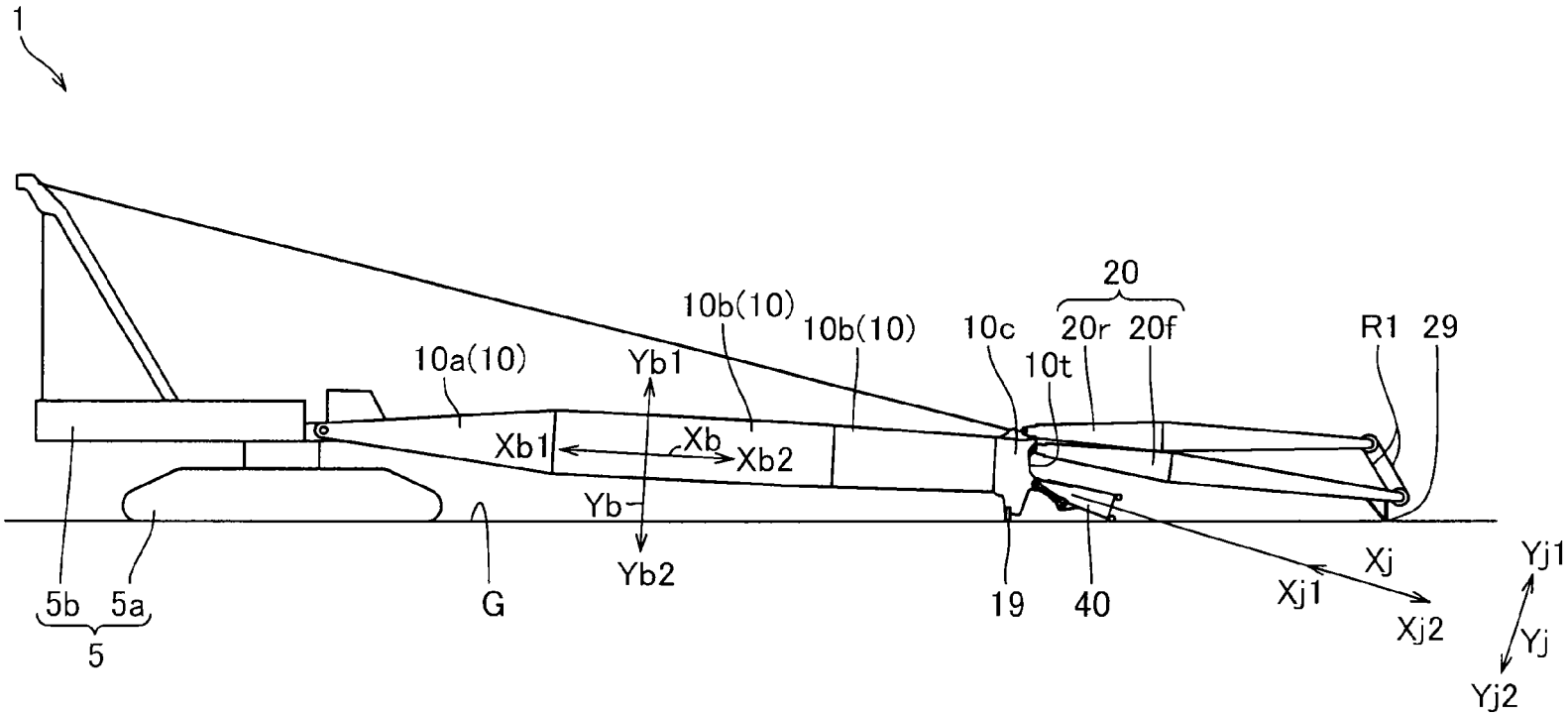
FIG. 2 is an overall view of the crane illustrated in FIG. 1 (after removal of an upper jib 31).

The boom 10 is attached to the crane body 5 in a raisable and lowerable manner. For example, the boom 10 may be a rod-type structural body having a lattice structure, i.e., a lattice boom. For example, each of the strut 20 and the jib 30 may be a rod-type structural body having a lattice structure, as with the boom 10. In the following description, as illustrated in FIG. 2, an axial direction of the boom 10 will be referred to as "boom axis direction Xb". Further, a side offset toward a base end of the boom 10 in the boom axis direction Xb will be referred to as "boom base end side Xb1", and a side offset toward a tip of the boom 10 in the boom axis direction Xb will be referred to as "boom tip side Xb2". On the other hand, an up-down direction of the boom 10 in a laid-down state thereof (state in which the boom 10 is lowered and laid down) will be referred to as "boom up-down direction Yb". Further, a back side of the laid-down boom 10 in the boom up-down direction Yb, i.e., an upper side of the laid-down boom 10, will be referred to as "boom back side Yb1", and a belly side of the laid-down boom 10 in the boom up-down direction Yb, i.e., an under side of the laid-down boom 10, will be referred to as "boom belly side Yb2".

The boom 10 is an assembling type, and configured to be disassembleable into a plurality of members in the boom axis direction Xb. The boom 10 comprises a lower boom 10*a*, an intermediate boom 10*b*, and a top boom 10*c*. The lower boom 10*a*, the intermediate boom 10*b* and the top boom 10*c* are arranged side-by-side in this order along a direction from the boom base end side Xb1 to the boom tip side Xb2. The intermediate boom 10*b* is configured to be able to be disassembled into a plurality of members in the boom axis direction Xb. Alternatively, the intermediate boom 10*b* may be configured to be unable to be disassembled into a plurality of members in the boom axis direction Xb. A head (tip portion) of the boom 10 will hereinafter be referred to as "boom head 10*t*".

Figure 3:
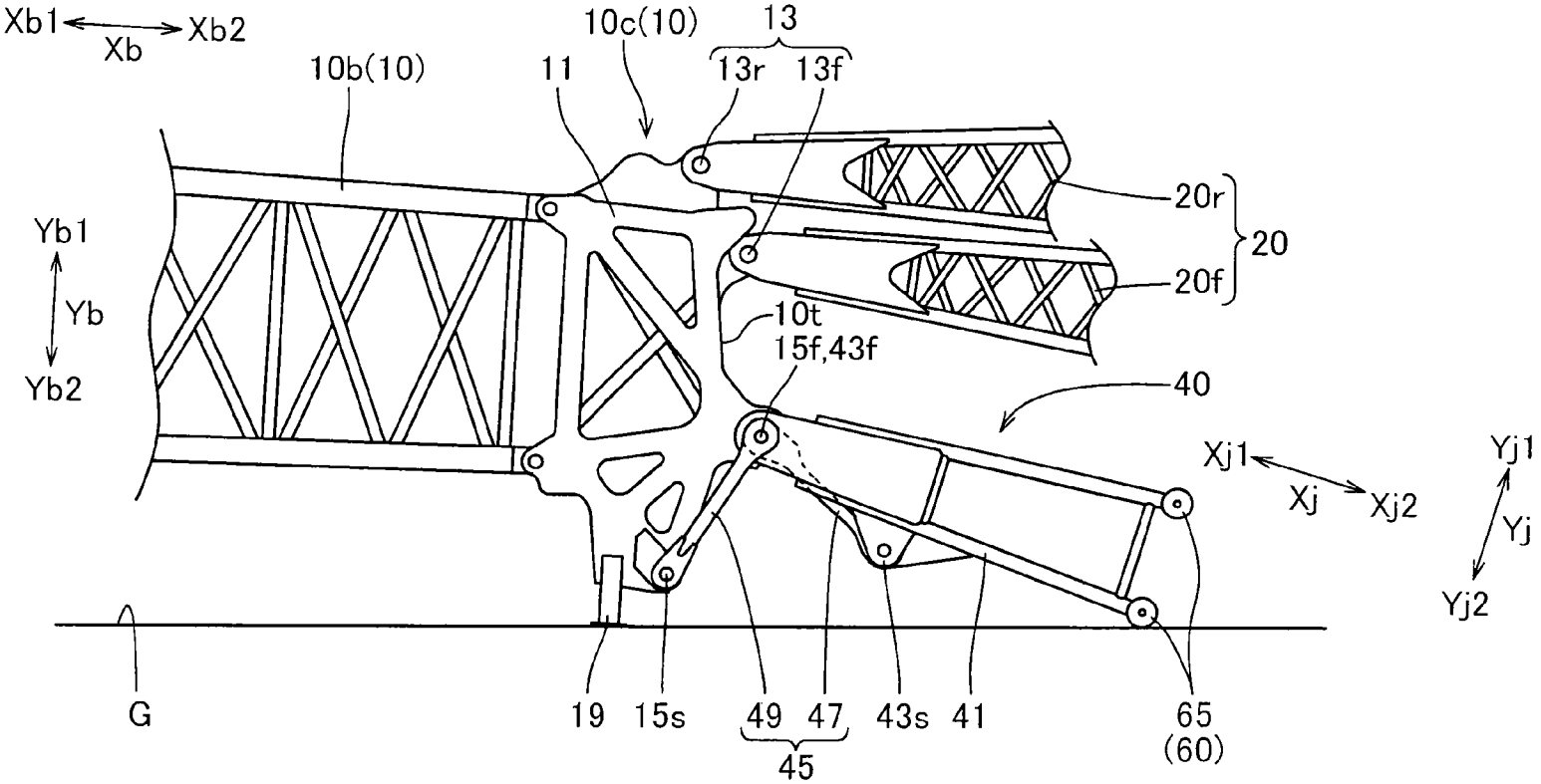
FIG. 3 is an enlarged view of an area around a boom head 10*t* in FIG. 2.

As illustrated in FIG. 3, the boom head 10*t* is configured to be able to cope with an enfolding-type attaching method as one method for attaching the jib 30 to the boom 10. The enfolding-type attaching method is as explained in the Background Art. The boom head 10*t* is a type capable of coping, for example, with the aforementioned enfolding support-type attaching method. Alternatively, the boom head 10*t* may be another type capable of coping, for example, with the aforementioned jib foot offset type attaching method. This embodiment will be described based on an example in which the boom head 10*t* is a type capable of coping with the enfolding support-type attaching method.

Figure 7A:
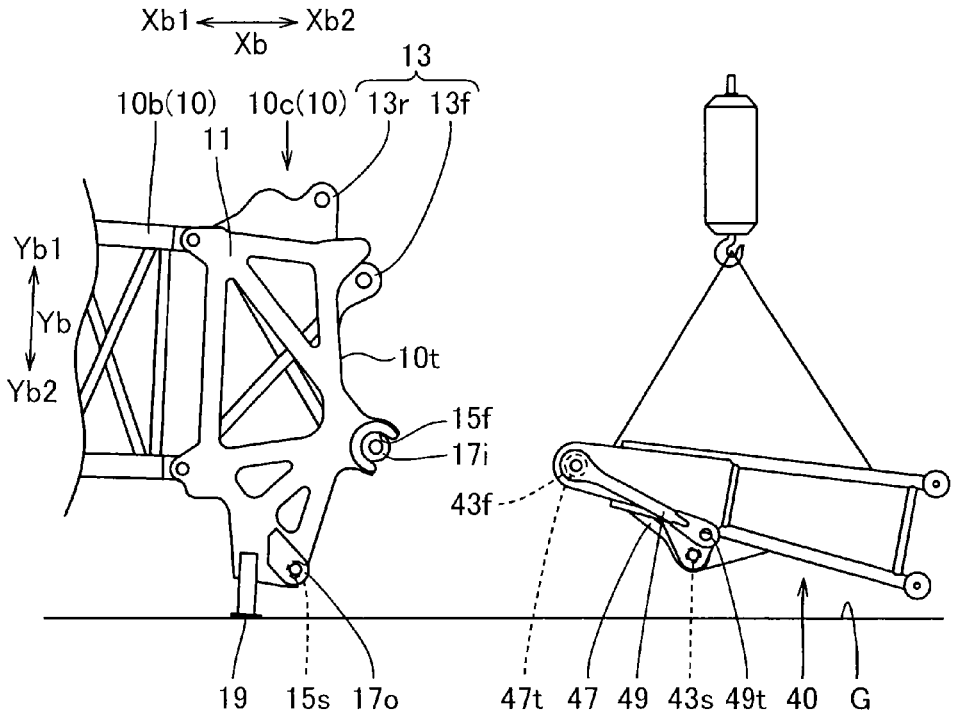
FIG. 7A is a schematic diagram illustrating a state before the lower jib 40 is attached to the boom head 10*t* illustrated in FIG. 3.

As illustrated in FIG. 7A, the boom head 10*t* comprises a boom head frame 11, a strut mounting portion 13, a boom-side jib foot 15*f*, a boom-side support portion 15*s*, an inner link mounting bracket 17*i*, an outer link mounting bracket 17*o*, and a boom head support portion 19. The strut mounting portion 13, the boom-side jib foot 15*f*, the boom-side support portion 15*s*, the inner link mounting bracket 17*i*, the outer link mounting bracket 17*o* and the boom head support portion 19 are provided in the boom head frame 11.

The strut mounting portion 13 comprises a front strut mounting portion 13*f*, and a rear strut mounting portion 13*r* disposed farther toward the boom back side Yb1 than the front strut mounting portion 13*f*.

Each of the boom-side jib foot 15*f* and the boom-side support portion 15*s* are formed in a U-shaped groove. The boom-side jib foot 15*f* is disposed farther toward the boom belly side Yb2 than the strut mounting portion 13. The boom-side support portion 15*s* is disposed farther toward the boom belly side Yb2 than the boom-side jib foot 15*f*.

The inner link mounting bracket 17*i* has a pin hole. The inner link mounting bracket 17*i* is provided in the boom head frame 11 in such a manner that the pin hole of the inner link mounting bracket 17*i* is disposed in coaxial relation with the boom-side jib foot 15*f*. The outer link mounting bracket 17*o* has a pin hole. The outer link mounting bracket 17*o* is provided in the boom head frame 11 in such a manner that the pin hole of the outer link mounting bracket 17*o* is disposed in coaxial relation with the boom-side support portion 15*s*.

The boom head support portion 19 is configured to be grounded, i.e., to be brought into contact with a ground surface G, when the boom 10 is fully lowered and laid down. The boom head support portion 19 is fixed to the boom head frame 11 in such a manner as to protrude from the boom head frame 11 toward the boom belly side Yb2 (see FIG. 2).

The strut 20 (see FIG. 1) is configured to raise and lower the jib 30 through a wire rope (not illustrated). As illustrated in FIG. 3, the strut 20 is attached to the strut mounting portion 13 of the boom head 10*t* in a raisable and lowerable manner. The strut 20 comprises a front strut 20*f* having a base end attached to the front strut mounting portion 13*f*, and a rear strut 20*r* having a base end attached to the rear strut mounting portion 13*r* and disposed rearward of the front strut 20*f*. The front strut 20*f* is an assembling type, and configured to be able to be disassembled into a plurality of members in an axial direction of the front strut 20*f*. The rear strut 20*r* is also configured to be able to be disassembled in the same manner.

As illustrated in FIG. 1, a distal end of the front strut 20*f* and a distal end of the rear strut 20*r* are coupled together, for example, via a jib raising and lowering rope R1. When the jib raising and lowering rope R1 is wound or unwound by a winch (not shown), an angle of the front strut 20*f* with respect to the rear strut 20*r* is changed. Alternatively, the distal end of the front strut 20*f* and the distal end of the rear strut 20*r* may be coupled together via a guy line which is not wound/unwound by a winch. As illustrated in FIG. 2, the front strut 20*f* is provided with a strut support portion 29. The strut support portion 29 is disposed at a distal end of the front strut 20*f*.

The strut support portion 29 is configured to be grounded when the boom 10 is lowered and laid down, and the front strut 20*f* is fully lowered and laid down. The strut support portion 29 is disposed to protrude from a body of the front strut 20*f* formed as a rod-type structural body, toward a belly side of the front strut 20*f* (an under side of the front strut 20*f* in the laid down posture).

The jib (luffing jib) 30 (see FIG. 1) is a structural body for suspending a load through a non-illustrated wire rope and a non-illustrated hook. The jib 30 is attached to the boom head 10*t* as illustrated in FIG. 1, and configured to be raisable and lowerable with respect to the boom 10. A method of attaching the jib 30 to the boom 10 includes an extending-type attaching method and an enfolding-type attaching method. In the extending-type attaching method, the jib 30 is laid in front of the boom 10 which is lowered and laid down, and, in this state, the jib 30 is attached to the boom 10. On the other hand, in the enfolding-type attaching method, an attaching operation is performed under a condition where the boom 10 and the jib 30 are arranged in state as illustrated in FIG. 1. Specifically, in the enfolding-type attaching method, the jib 30 is disposed under the boom 10 which is lowered and laid down, and, in this state, the jib 30 is attached to the boom 10. In the following description, an axial direction of the jib 30 will be referred to as "jib axis direction Xj". Further, a side offset toward a base end of the jib 30 in the jib axis direction Xj will be referred to as "jib base end side Xj1", and a side offset toward a tip of the jib 30 in the jib axis direction Xj will be referred to as "jib tip side Xj2". On the other hand, an up-down direction of the jib 30 in a state in which the jib 30 is disposed in an enfolded posture as illustrated in FIG. 1, will be referred to as "jib up-down direction Yj". Further, a back side of the enfolded jib 30 in the jib up-down direction Yj, i.e., an under side of the jib 30 in the enfolded posture, will be referred to as "jib back side Yj1". A belly side of the enfolded jib 30 in the jib up-down direction Yj, i.e., an upper side of the jib 30 in the enfolded posture, will be referred to as "jib belly side Yj2". A lateral direction of the jib 30, i.e., a direction perpendicular to both of the jib axis direction Xj and the jib up-down direction Yj, will hereinafter be referred to as "jib lateral direction Zj"

The jib 30 is an assembling type, and configured to be able to be divided into a plurality of members in the jib axis direction Xj. The jib 30 comprises an upper jib 31, and a lower jib 40.

The upper jib 31 is coupled to an end of the lower jib 40 on the jib tip side Xj2, in such a manner as to be separable with respect to the lower jib 40. The upper jib 31 is configured to be able to be divided into a plurality of members in the jib axis direction Xj. For example, the upper jib 31 comprises a top jib 31*a*, an intermediate jib 31*b* and an intermediate tapered jib 31*c*. The top jib 31*a*, the intermediate jib 31*b* and the intermediate tapered jib 31*c* are arranged side-by-side in this order along a direction from the jib tip side Xj2 to the jib base end side Xj1.

Figure 9:
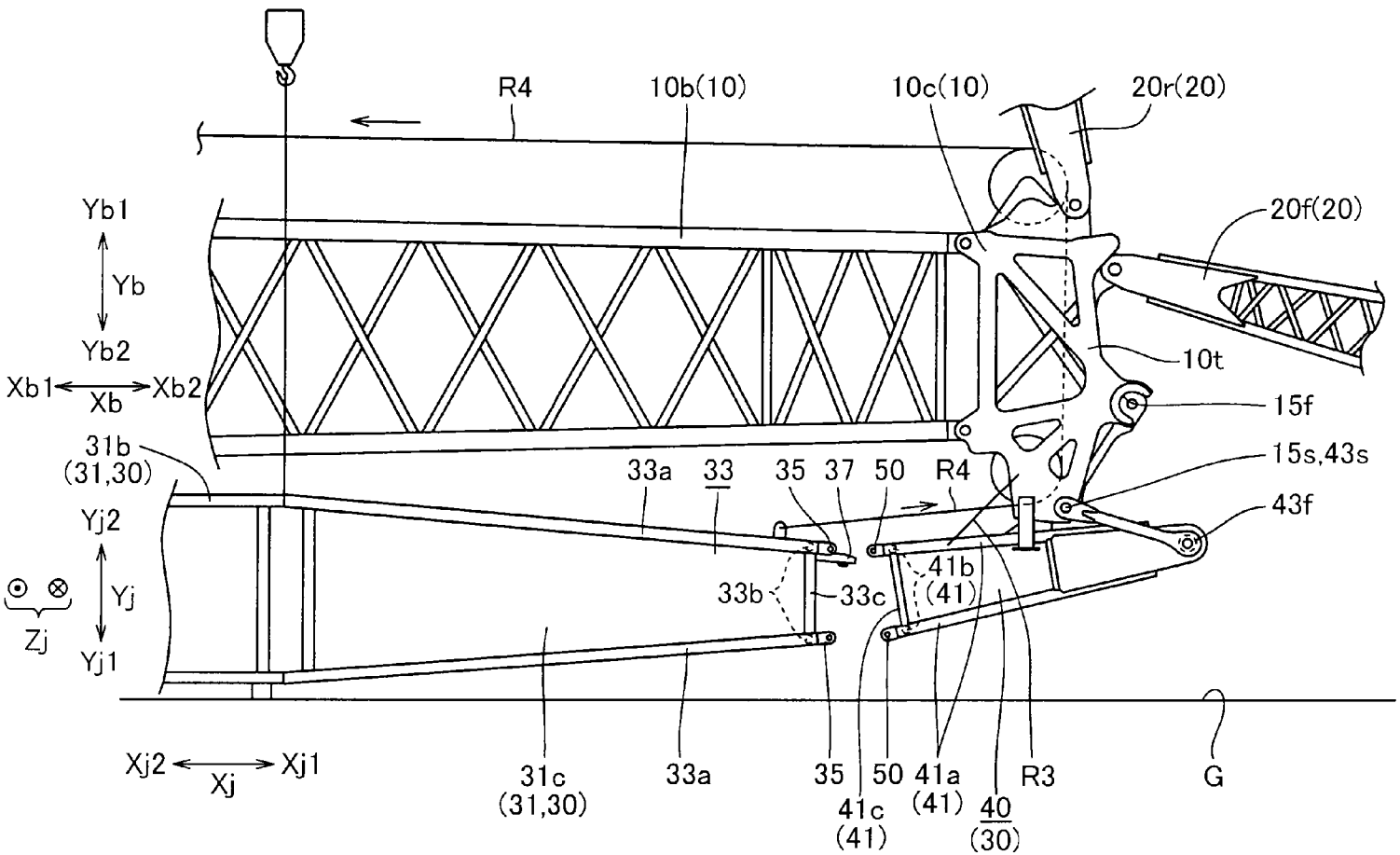
FIG. 9 is a schematic diagram illustrating a state before the upper jib 31 is attached to the lower jib 40.

As illustrated in FIG. 9, the intermediate tapered jib 31*c* of the upper jib 31 comprises an upper jib frame 33, an upper-side connector 35, and a guide bracket 37. Both of the upper-side connector 35 and the guide bracket 37 are provided in a coupling section of the intermediate tapered jib 31*c* with respect to the lower jib 40.

The upper jib frame 33 is composed of a plurality of pipes. Specifically, the upper jib frame 33 comprises four main members 33*a*, two base-end lateral members 33*b*, and two base-end perpendicular members 33*c*. Each of the main members 33*a* is disposed at a respective one of four corners of a quadrangular cross-section of the upper jib frame 33, when viewed in the jib axis direction Xj. The base-end lateral members 33*b* and the base-end perpendicular members 33*c* are arranged at an end of the upper jib frame 33 on the jib base end side Xj1. Each of the base-end lateral members 33*b* is disposed to extend in the jib lateral direction Zj. Each of the base-end perpendicular members 33*c* is disposed to extend in the jib up-down direction Yj.

Figure 10A:
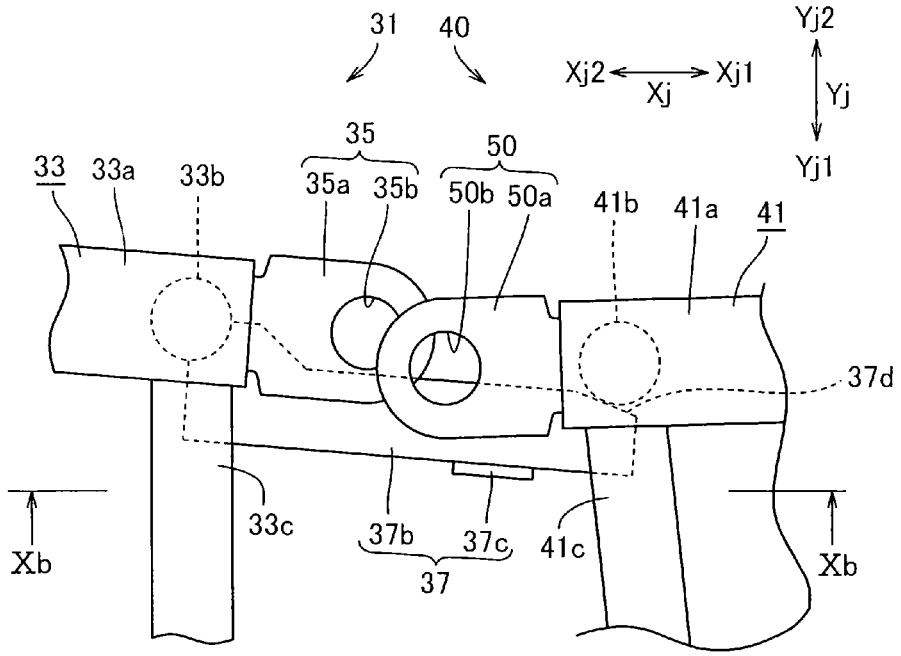
FIG. 10A is an enlarged view of an area around a guide bracket 37, wherein it illustrates a state before the lower jib 40 and the upper jib 31 are coupled together.
Figure 10B:
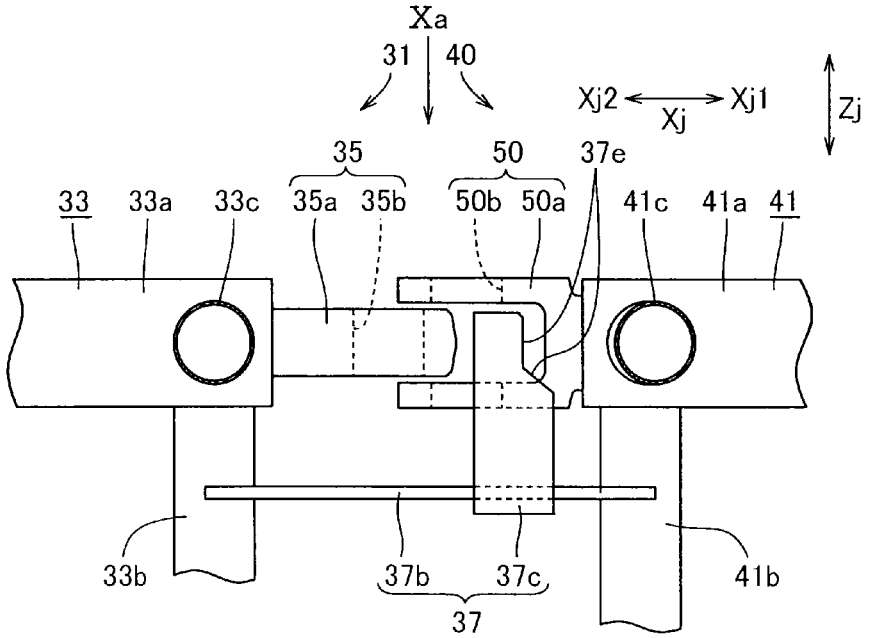
FIG. 10B is an enlarged view of the area around the guide bracket 37, when viewed from a direction indicated by the arrow Xb in FIG. 10A.

The upper-side connector 35 is configured to be joined to an aftermentioned lower-side connector 50 of the lower jib 40, thereby allowing the intermediate tapered jib 31*c* of the upper jib 31 and the lower jib 40 to be coupled together. The upper-side connector 35 is fixed to each end of the four main members 33*a* on the jib base end side Xj1, that is, the upper-side connector 35 is provided in a number of four, wherein the four upper-side connectors 35 are fixed, respectively, to four ends of the main members 33*a* on the jib base end side Xj1. As illustrated in FIGS. 10A and 10B, each of the upper-side connectors 35 has one plate-shaped portion 35*a*. Alternatively, each of the upper-side connectors 35 may have two plate-shaped portions 35*a*. The plate-shaped portion 35*a* is formed with a pin hole 35*b*. FIG. 10A is an enlarged view of the area around the guide bracket 37, when viewed from a direction indicated by the arrow Xa in FIG. 10B, and FIG. 10B is an enlarged view of the area around the guide bracket 37, when viewed from a direction indicated by the arrow Xb in FIG. 10A.

The guide bracket 37 is configured to facilitate a position adjustment between the pin hole 35*b* of the upper-side connector 35 and a pin hole 50*b* of the aftermentioned lower-side connector 50. In other words, the guide bracket 37 is configured to guide the aftermentioned lower-side connector 50 and the upper-side connector 35 to a specific relative position where positions of the pin holes 50*b*, 35*b* of the lower-side and upper-side connectors 50, 35 are aligned with each other. As illustrated in FIG. 9, the guide bracket 37 is disposed adjacent to at least one of the four upper-side connectors 35. For example, the guide bracket 37 is provided in a number of two, wherein the two guide brackets 37 are disposed adjacent to two of the four upper-side connectors 35 on the jib belly side Yj2, respectively. The guide bracket 37 is fixed to an end of the upper jib frame 33 on the jib base end side Xj1, i.e., to an end of the upper jib frame 33 to which the lower jib 40 is coupled. For example, the guide bracket 37 is fixed to the base-end lateral member 33*b*, as illustrated in FIGS. 10A and 10B. The guide bracket 37 comprises a lateral-member guide member 37*b*, and a perpendicular-member guide member 37*c*.

Figure 11A:
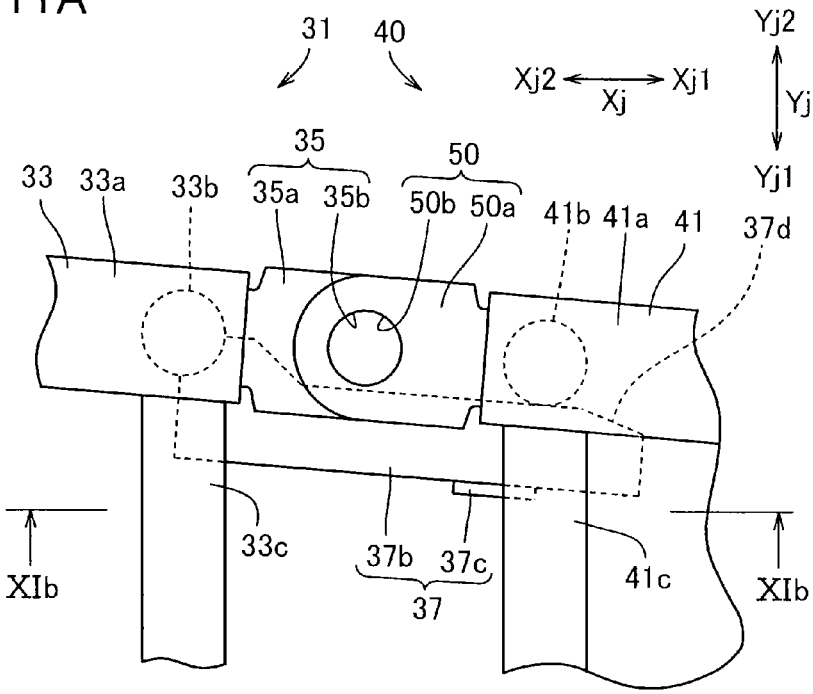
FIG. 11A is an enlarged view corresponding to FIG. 10A, which illustrates a state after the lower jib 40 and the upper jib 31 are coupled together.
Figure 11B:
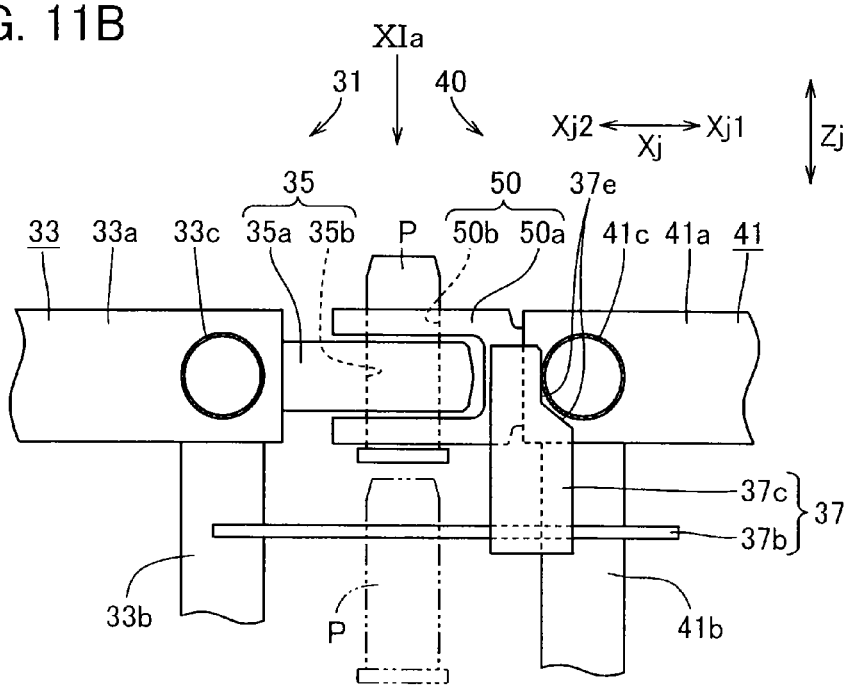
FIG. 11B is an enlarged view of the area around the guide bracket 37, when viewed from a direction indicated by the arrow XIb in FIG. 11A.

The lateral-member guide member 37*b* is a portion for performing a position adjustment between the pin hole 35*b* and the pin hole 50*b* in the jib up-down direction Yj. The lateral-member guide member 37*b* is fixed to the base-end lateral member 33*b* to extend from the base-end lateral member 33*b* toward the jib base end side Xj1. As illustrated in FIG. 11A, the lateral-member guide member 37*b* is configured to support an aftermentioned distal-end lateral member 41*b* from therebelow when the position of the pin hole 35*b* and the position of the pin hole 50*b* are aligned with each other (this state will hereinafter be referred to as "state A"). FIG. 11A is an enlarged view of the area around the guide bracket 37, when viewed from a direction indicated by the arrow XIa in FIG. 11B, and FIG. 11B is an enlarged view of the area around the guide bracket 37, when viewed from a direction indicated by the arrow XIb in FIG. 11A. The lateral-member guide member 37*b* has an inclined portion 37*d*. The inclined portion 37*d* is formed in an upper region of a distal end of the lateral-member guide member 37*b*.

The perpendicular-member guide member 37*c* is a portion for performing a position adjustment between the pin hole 35*b* and the pin hole 50*b* in the jib axis direction Xj. The perpendicular-member guide member 37*c* is fixed to the lateral-member guide member 37*b* to extend outwardly from the lateral-member guide member 37*b* in the jib lateral direction Zj. Alternatively, the perpendicular-member guide member 37*c* may be provided as a separate member separated from the lateral-member guide member 37*b*. The perpendicular-member guide member 37*c* is configured to be brought into contact with an aftermentioned distal-end perpendicular member 41*c* in the jib axis direction Xj when the position of the pin hole 35*b* and the position of the pin hole 50*b* are aligned with each other (in the "state A"). Specifically, the perpendicular-member guide member 37*c* is configured such that, in the "state A", an end thereof on the jib base end side Xj1 is brought into contact with the aftermentioned distal-end perpendicular member 41*c*, in opposed relation thereto in the jib axis direction Xj. The perpendicular-member guide member 37*c* has a stepped portion 37*e*. The stepped portion 37*e* is formed to be brought into contact with the aftermentioned distal-end perpendicular member 41*c* in the "state A". The stepped portion 37*e* is formed to extend approximately along the aftermentioned distal-end perpendicular member 41*c* in the "state A".

As illustrated in FIG. 1, the intermediate jib 31*b* is coupled to an end of the intermediate tapered jib 31*c* on the jib tip end side Xj2. Further, the top jib 31*a* is coupled to an end of the intermediate jib 31*b* on the jib tip side Xj2.

Figure 4:
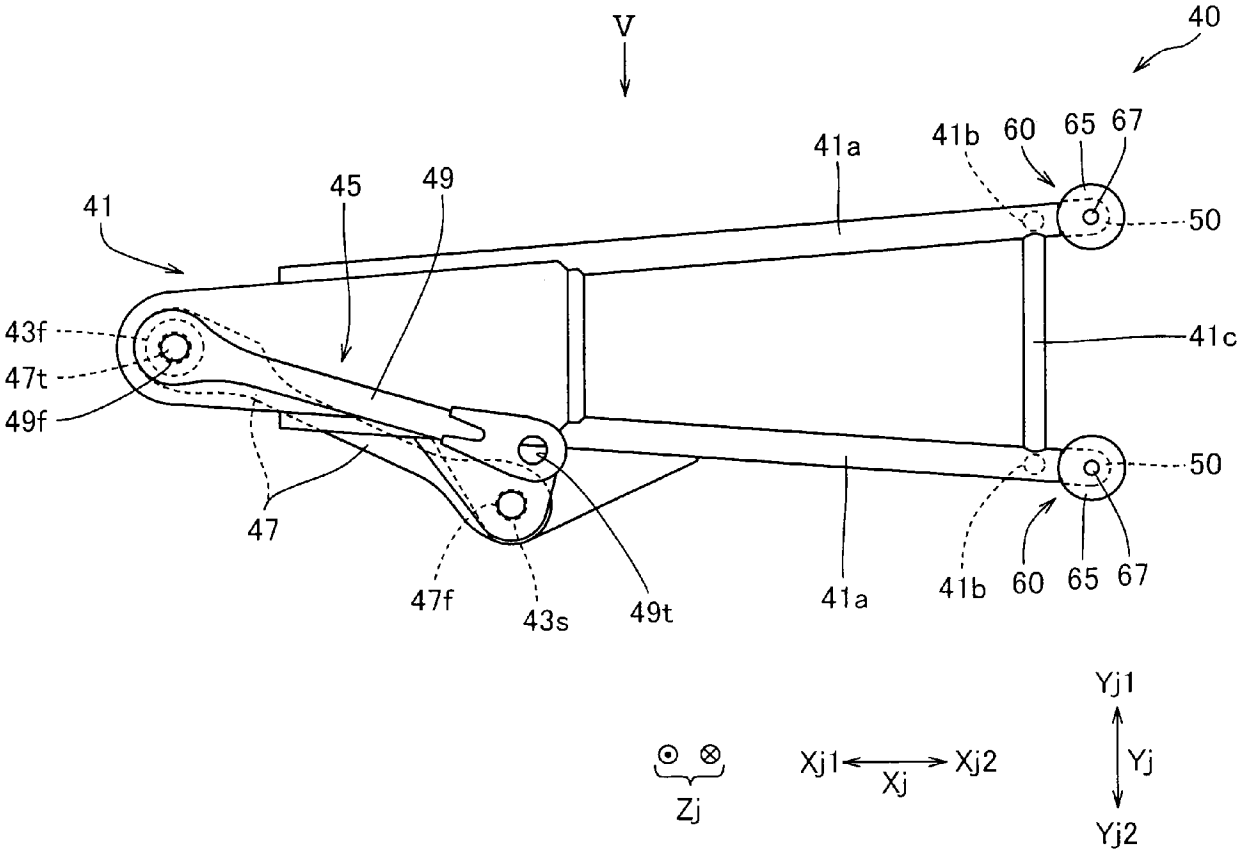
FIG. 4 is a schematic diagram illustrating a lower jib 40 illustrated in FIG. 3.

As illustrated in FIG. 1, among a plurality of elements of the jib 30 dividable in the jib axis direction Xj, the lower jib 40 is an element located at an endmost position on the jib base end side Xj1. Conventionally, an element equivalent to an assembly obtained by integrating the lower jib 40 and the intermediate tapered jib 31*c* together has been called "lower jib". As compared to such a conventional "lower jib", the lower jib 40 in this embodiment has a shorter length in the jib axis direction Xj. Details of the dimensions of the lower jib 40 will be specifically described in aftermentioned Section "Strut Attaching Step". The lower jib 40 makes up a portion of the jib 30 extending over a specific length range from the base end of the jib 30 toward the tip of the jib 30, and is attached to the boom head 10*t* in a raisable and lowerable manner, at a position located below an attaching position of a base end of the strut 20 to the boom head 10*t* in a state in which the boom 10 is lowered and laid down. As illustrated in FIG. 4, the lower jib 40 comprises a lower jib frame 41, a jib-side jib foot 43*f*, a jib-side support portion 43*s*, an enfolding link mechanism 45, a lower-side connector 50, and a roller unit 60. Each of the jib-side jib foot 43*f*, the jib-side support portion 43*s*, the enfolding link mechanism 45, the lower-side connector 50 and the roller unit 60 is provided in the lower jib frame 41.

The lower jib frame 41 is one example of a "frame" set forth in the appended claims. The lower jib frame 41 is, as it were, a body of the lower jib 40, and formed in an approximately triangle pillar shape. The lower jib frame 41 is formed using a pipe, a plate, etc. to extend from the jib-side jib foot 43*f* to a distal end of the lower jib 40. Specifically, the lower jib frame 41 comprises four main members 41*a*, two distal-end lateral members 41*b*, and two distal-end perpendicular members 41*c*. Each of the main members 41*a* is disposed at a respective one of four corners of a quadrangular cross-section of the lower jib frame 41, when viewed in the jib axis direction Xj. The distal-end lateral members 41*b* and the distal-end perpendicular members 41*c* are arranged at an end of the lower jib frame 41 on the jib tip side Xj2, i.e., at an end of the lower jib frame 41 to which the intermediate tapered jib 31*c* is coupled. Each of the distal-end lateral members 41*b* is disposed to extend in the jib lateral direction Zj (in the lateral direction of the jib 30). Each of the distal-end perpendicular members 41*c* is disposed to extend in the jib up-down direction Yj (in the direction perpendicular to the lateral and axial directions of the jib 30).

The jib-side jib foot 43*f* (see FIG. 3) is one example of a "jib foot" set forth in the appended claims, and serves as a pivot shaft of the jib 30 when the jib 30 (see FIG. 1) is rotated with respect to the boom 10 during a crane work or the like. Only when a jib angle ψ (see FIG. 8A) of the jib 30 with respect to the boom 10 is equal to or greater than a predetermined value (e.g., about 85 degrees), the jib-side jib foot 43*f* functions as a pivot shaft of the jib 30. As used here, the term "jib angle ψ" means an angle defined between a central axis of the boom 10 and a central axis of the jib 30. The jib-side jib foot 43*f* is formed in a shape attachable to, specifically fittable into, the boom-side jib foot 15*f*. The jib-side jib foot 43*f* is provided at a base end of the lower jib 40, i.e., at an end of the lower jib 40 on the jib base end side Xj1, and fixed to the lower jib frame 41.

The jib-side support portion 43*s* serves as a pivot shaft of the jib 30 when the jib 30 is rotated with respect to the boom 10, in order to perform an operation, for example, of attaching the upper jib 31 to the lower jib 40 in an enfolded state of the jib 30, as illustrated in FIG. 9. Only when the jib angle ψ (see FIG. 8B) of the jib 30 with respect to the boom 10 is less than the predetermined value (e.g., about 85 degrees), the jib-side support portion 43*s* functions as a pivot shaft of the jib 30. The jib-side support portion 43*s* is formed in a shape attachable to, specifically fittable into, the boom-side support portion 15*s*. The jib-side support portion 43*s* is disposed farther toward the jib tip side Xj2 than the jib-side jib foot 43*f*, and fixed to the lower jib frame 41.

Figure 5:
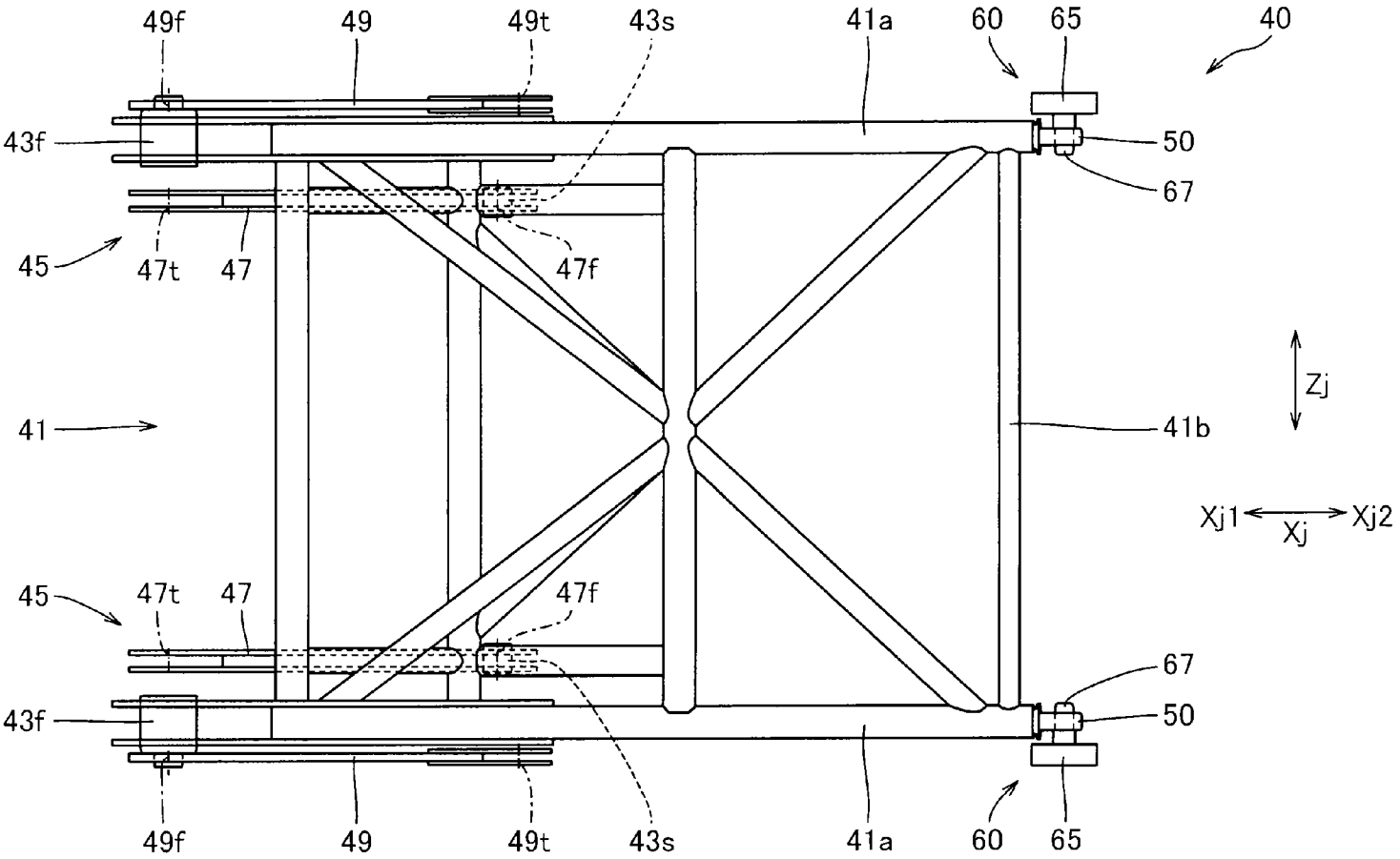
FIG. 5 is a schematic diagram of the lower jib 40, when viewed from a direction indicated by the arrow V in FIG. 4.

The enfolding link mechanism 45 is a mechanism for coupling the lower jib 40 and the boom head 10*t*. As illustrated in FIG. 5, the enfolding link mechanism 45 comprises two inner links 47 and two outer links 49.

The inner links 47 are provided, respectively, at two positions inward of respective pairs of the main members 41*a* of the lower jib frame 41 located on opposite sides in the jib lateral direction Zj. As illustrated in FIG. 4, each of the inner links 47 is rotatably attached to the lower jib frame 41. A base end 47*f* of the inner link 47 which serves as a center of rotation of the inner link 47 with respect to the lower jib frame 41 is disposed in coaxial relation with the jib-side support portion 43*s*. A distal end 47*t* of the inner link 47 is configured to be attachable to the inner link mounting bracket 17*i* of the boom head 10*t* illustrated in FIG. 7A.

As illustrated in FIG. 5, the outer links 49 are provided, respectively, at two positions outward of respective pairs of the main members 41*a* of the lower jib frame 41 located on the opposite sides in the jib lateral direction Zj. As illustrated in FIG. 4, each of the outer links 49 is rotatably attached to the lower jib frame 41. A base end 49*f* of the outer link 49 which serves as a center of rotation of the outer link 49 with respect to the lower jib frame 41 is disposed in coaxial relation with the jib-side jib foot 43*f*. A distal end 49*t* of the outer link 49 is configured to be attachable to the outer link mounting bracket 17*o* of the boom head 10*t* illustrated in FIG. 7A.

Figure 6:
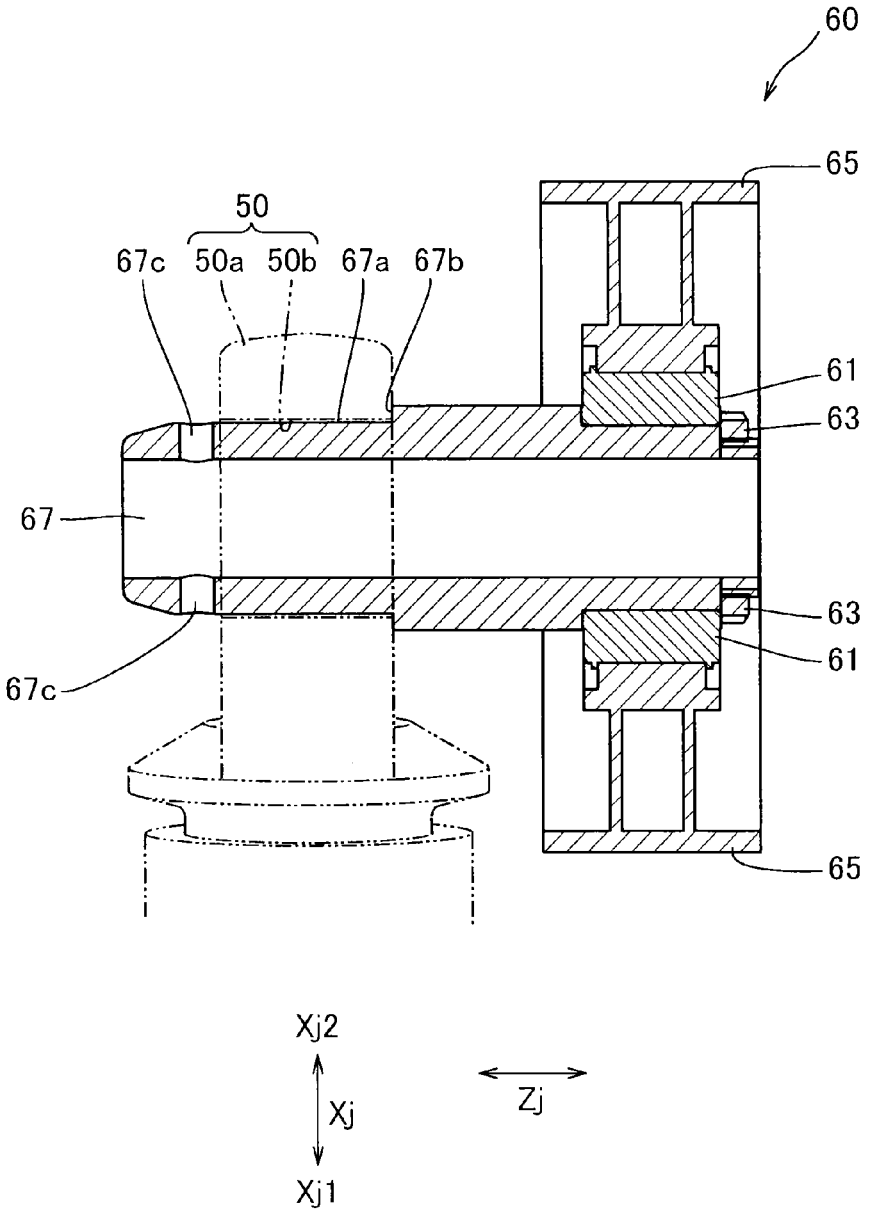
FIG. 6 is a sectional view of a roller section 60 illustrated in FIG. 5.

The lower-side connector 50 (see FIG. 9) is configured to be joined to the upper jib 31, thereby allowing the lower jib frame 41 of the lower jib 40 and the upper jib 31 to be coupled together. The lower-side connector 50 is provided at an end of the lower jib 40 on a side opposite to the boom head 10*t*. Specifically, as illustrated in FIG. 4, the lower-side connector 50 is fixed to each end of the four main members 41*a* of the lower jib frame 41 on the jib tip side Xj2, that is, the lower-side connector 50 is provided in a number of four, wherein the four lower-side connectors 50 are fixed, respectively, to four ends of the main members 41*a* on the jib tip side Xj2. The following description will be made about one of the lower-side connectors 50. As illustrated in FIGS. 10A and 10B, for example, the lower-side connector 50 has two plate-shaped portions 50*a*. Each of the plate-shaped portions 50*a* is formed with a pin hole 50*b*. In the case where each of the upper-side connectors 35 has two plate-shaped portions 35*a* (not illustrated), the lower-side connector 50 to be joined to the upper-side connector 35 is formed to have one plate-shaped portion 50*a*, as illustrated in FIG. 6. Each of the pin holes 50*b* and the pin hole 35*b* is configured to allow a pin P for coupling the upper-side connector 35 of the upper jib 31 to the lower-side connector 50, and an aftermentioned roller shaft 67, to be selectively inserted thereinto. As illustrated in FIG. 11B, the lower-side connector 50 and the upper-side connector 35 are coupled together by inserting the pin P into the pin holes 50*b* and the pin hole 35*b*.

The roller unit 60 is a unit comprising an aftermentioned roller 65, etc., as illustrated in FIG. 4. Specifically, as illustrated in FIG. 6, the roller unit 60 comprises a roller 65, a roller shaft 67, a bearing 61, and a lock nut 63. The bearing 61 supports the roller 65*b* with respect to the roller shaft 67 in such a manner that the roller 65 becomes rotatable with respect to the roller shaft 67. The lock nut 63 fixes the bearing 61 to the roller shaft 67.

The roller 65 is configured, under a condition where the upper jib 31 is separated from the lower jib 40, to be rollingly movable with respect to the ground surface G, while supporting, with respect to the ground surface G, an end of the lower jib 40 on a side opposite to the boom head 10*t*. As illustrated in FIGS. 7A and 8A, this roller 65 facilitates turning-over of the lower jib 40. Details of the turning-over of the lower jib 40 will be described in aftermentioned Section "Lower Jib Turning-over Step". The roller 65 facilitate a sliding movement of the end of the lower jib 40 on the side opposite to the boom head 10*t*, i.e., a sliding movement of the end of the lower jib 40 on the jib tip side Xj2, with respect to the ground surface G (see FIG. 7B). A direction along which a rotation shaft of the roller 65 extends, i.e., an axial direction of the roller shaft 67, conforms to the jib lateral direction Zj. Under the condition where the upper jib 31 is separated from the lower jib 40, the roller 65 is attached to an end of the lower jib frame 41 on the jib tip side Xj2. For example, the roller 65 is attached to the main member 41*a* through the lower-side connector 50. Alternatively, the roller 65 may be attached, for example, to the distal-end perpendicular member 41*c* or the distal-end lateral member 41*b*, as in an aftermentioned second modified embodiment. As illustrated in FIG. 6, the roller 65 is disposed adjacent to the plate-shaped portion 50*a* of the lower-side connector 50. As illustrated in FIG. 5, the roller 65 is disposed outwardly in the jib lateral direction Zj with respect to the plate-shaped portion 50*a* (see FIG. 6). Alternatively, the roller 65 may be disposed inwardly in the jib lateral direction Zj with respect to the plate-shaped portion 50*a*.

The roller shaft 67 is a rotation shaft of the roller 65. Under the condition where the upper jib 31 is separated from the lower jib 40, the roller shaft 67 is inserted into the pin hole 50*b* of the lower-side connector 50 as illustrated in FIG. 6, and thereby attached to the pin hole 50*b*. The roller shaft 67 is fixed to the plate-shaped portion 50*a*. For example, the roller shaft 67 has an insertion portion 67*a*, a stepped portion 67*b*, and a fixing pin mounting hole 67*c*. The insertion portion 67*a* is formed to be inserted into the pin hole 50*b*. The stepped portion 67*b* is provided closer to the roller 65 than the insertion portion 67*a*, and formed to be butted against the plate-shaped portion 50*a*. A fixing pin (not illustrated) is inserted into the fixing pin mounting hole 67*c* to fix the roller shaft 67 to the lower-side connector 50. The fixing pin mounting hole 67*c* is provided in an end of the insertion portion 67*a* which is penetrated through the pin hole 50*b* and located on a side opposite to the stepped portion 67*b*, i.e., on a side opposite to the roller 65.

The roller shaft 67 may be formed to be additionally usable as the pin P for coupling the upper-side connector 35 and the lower-side connector 50 together, illustrated in FIG. 11B. When the roller shaft 67 is additionally used as the pin P, the number of components of the lower jib 40 can be reduced, as compared to the case where the roller shaft 67 and the pin P are separate components.

<Crane Assembling Method>

A crane assembling method according to this embodiment will be described below approximately according to a sequence of steps. It should be noted that a sequence of aftermentioned steps may be arbitrarily changed. The crane assembling method comprises a preparation step, a boom attaching step, a jib attaching and assembling step, and a strut attaching step.

[Preparation Step]

In the preparation step, the crane body 5 is prepared and provided with the reeving winch 7.

[Boom Attaching Step]

In the boom attaching step, the boom 10 is attached to the upper slewing body 5*b* of the crane body 5.

[Jib Attaching and Assembling Step]

In the jib attaching and assembling step, the jib 30 is attached to the boom head 10*t*, and the jib 30 is assembled. In this embodiment, the strut attaching step is performed during a course of the jib attaching and assembling step. The jib attaching and assembling step comprises a lower jib attaching substep, a lower jib turning-over substep, and an upper jib coupling substep.

(Lower Jib Attaching Substep)

In the lower jib attaching substep, as illustrated in 7A, the lower jib 40 is joined to the boom head 10*t* from a front side (which will be defined later) of the laid-down boom 10. This substep is performed as follows.

(1a) The boom 10 is lowered and laid down, and the boom head support portion 19 is grounded. In this embodiment, a side beyond the boom head 10*t* in a direction toward the boom tip side Xb2 will hereinafter be referred to as "front side" of the laid-down boom 10.

(1b) The lower jib 40 is hoisted up by an auxiliary crane other than the crane 1.

(1c) The jib-side jib foot 43*f* is fitted into the boom-side jib foot 15*f* from the front side of the laid-down boom 10. This fitting operation is easier than that in the conventional enfolding-type attaching method, i.e., an operation of fitting jib-side jib foot 43*f* into the boom-side jib foot 15*f* from below the laid-down boom 10.

(1d) The distal end 47*t* of the inner link 47 is attached to the inner link mounting bracket 17*i* through a pin (not illustrated).

Figure 7B:
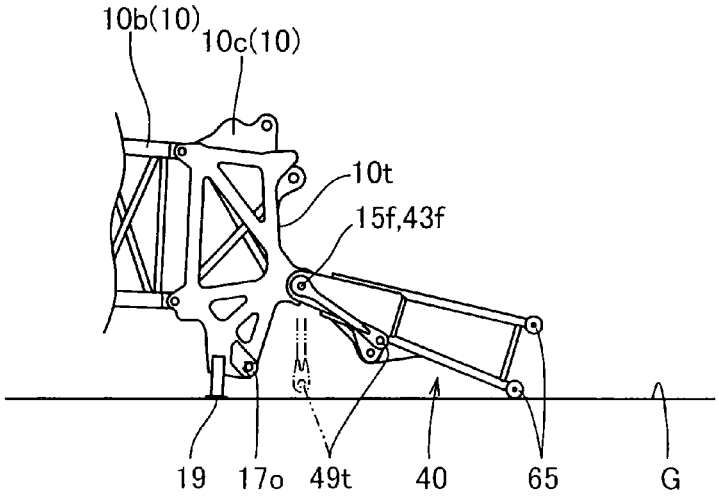
FIG. 7B is a schematic diagram illustrating a state after the lower jib 40 is attached to the boom head 10*t* illustrated in FIG. 7A.
Figure 8A:
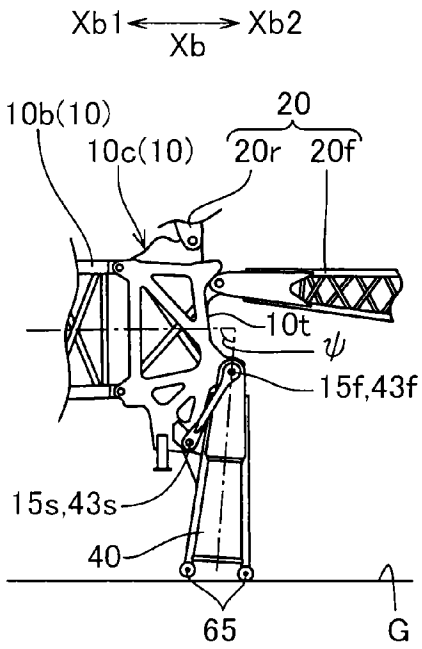
FIGS. 8A, 8B and 8C are schematic diagrams illustrating a process of turning over the lower jib 40 with respect to the boom head 10*t* illustrated in FIG. 3.

(1e) As illustrated in FIG. 7B, the lower jib 40 is rotated toward the ground surfaces G to allow the roller 65 to be grounded.

(1f) The distal end 49*t* of the outer link 49 is attached to the outer link mounting bracket 17*o* through a pin (not illustrated).

In the above way, before attaching the strut 20 (see FIG. 2) to the boom head 10*t*, the lower jib 40 is attached to the boom head 10*t*. Therefore, the strut 20 never hinders the above operations (1b) to (1f). This makes it possible to facilitate the operation of attaching the lower jib 40 to the boom head 10*t*.

[Strut Attaching Step]

In the strut attaching step, the strut 20 is attached to the boom head 10*t*, as illustrated in FIG. 3. This step is performed as follows.

(2a) The front strut 20*f* is attached to the front strut mounting portion 13*f*. During this operation, the lower jib 40 is disposed on the front side of the laid-down boom 10. Thus, the boom head support portion 19 can be grounded. Assuming that the lower jib 40 is turned over as illustrated in FIG. 8C, the boom head support portion 19 of the boom head 10*t* cannot be grounded. The boom head support portion 19 of the boom head 10*t* is grounded in this manner, so that it becomes possible to suppress an undesirable situation where the front strut mounting portion 13*f* is excessively lifted with respect to the ground surface G.

(2b) As illustrated in FIG. 2, the strut support portion 29 at the distal end of the front strut 20*f* is grounded. The lower jib 40 has a length less than that of the conventional lower jib. This allows the front strut 20*f* to have such a posture. Specifically, the lower jib 40 is attached to the boom head 10*t* in such a manner that the jib-side jib foot 43*f* is attached to the boom head 10*t* of the boom 10, and the lower jib frame 41 is disposed beyond the boom head 10*t* in a direction toward the boom tip side Xb2, as illustrated in FIG. 3, wherein, under the condition where the upper jib 31 is separated from the lower jib 40, when the boom 10 is lowered and laid down to allow the boom head support portion 19 of the boom head 10*t* to be grounded, as illustrated in FIG. 2, and the front strut 20*f* is lowered and laid down to allow the strut support portion 29 at the distal end of the front strut 20*f* to be grounded, the lower jib 40 has a laid-down posture at a position between the boom 10 and the front strut 20*f*. Further, the lower jib 40 has a length which causes no interference with the front strut 20*f* when the lower jib 40 has the laid-down posture.

(2c) As illustrated in FIG. 3, the rear strut 20*r* is attached to the rear strut mounting portion 13*r*. During this operation, the boom head support portion 19 of the boom head 10*t* is grounded in the same manner as that during the operation (2*a*) of attaching the front strut 20*f* to the front strut mounting portion 13*f*, so that it becomes possible to suppress an undesirable situation where the rear strut mounting portion 13*r* is excessively lifted with respect to the ground surface G.

(2d) As illustrated in FIG. 2, the jib raising and lowering rope R1 is attached to respective distal ends of the front and rear struts 20*f*, 20*r*. During this operation, the strut support portion 29 at the distal end of the front strut 20*f* is grounded. Thus, it becomes possible to suppress an undesirable situation where a position of an assembling operation at the distal end of the strut 20 becomes excessively high with respect to the ground surface G.

(2e) As illustrated in FIG. 1, the strut 20 is raised to a position for a crane work.

(Lower Jib Turning-over Substep)

Figure 8B:
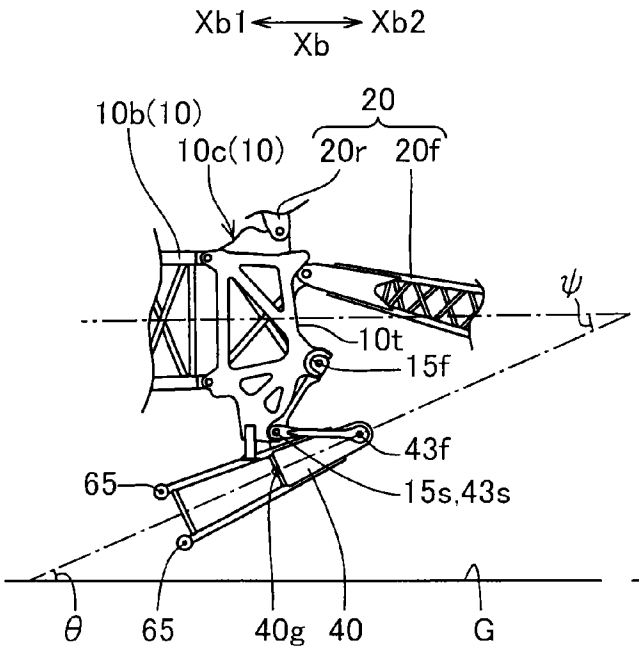
Figure 8C:
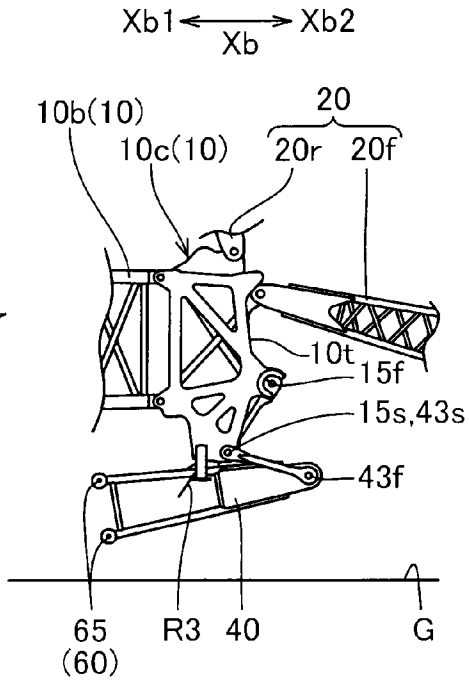

In the lower jib turning-over substep, as illustrated in FIGS. 8A to 8C, the distal end of the lower jib 40 is turned over from the boom tip side Xb2 toward the boom base end side Xb1. This substep is performed as follows.

(3a) The boom 10 illustrated in FIG. 3 is gradually raised. Accordingly, the lower jib 40 rotates while slidingly moving with respect to the ground surface G. During this rotation, a rotation center of the lower jib 40 is the boom-side jib foot 15*f*.

(3b) As illustrated in FIG. 8A, when the jib angle ψ of the lower jib 40 with respect to the boom 10 reaches the predetermined value (e.g., 85 degrees), the jib-side support portion 43*s* is fitted into the boom-side support portion 15*s*.

(3c) When the boom 10 is further raised, the lower jib 40 rotates about the boom-side support portion 15*s*.

(3d) As a result, as illustrated in FIG. 8B, the lower jib 40 rotates until a gravity center 40*g* of the lower jib 40 is moved to a position just below the boom-side support portion 15*s*.

(3e) When the gravity center 40*g* of the lower jib 40 reaches the position just below the boom-side support portion 15*s*, an angle θ defined between the central axis of the lower jib 40 and the ground surface G (horizontal direction) is at least less than 90 degrees, preferably, equal to or less than 60 degrees, 45 degrees or 30 degrees.

(3f) Then, when the boom 10 is lowered to allow the lower jib 40 to be grounded, the lower jib 40 is further rotated.

(3g) The boom head 10*t* and the lower jib 40 are coupled together by a coupling rope R3. This restricts a rotation of the lower jib 40 with respect to the boom 10. Thus, it becomes possible to restrict an inclination of the lower jib 40 with respect to the upper jib 31, when the upper jib 31 is connected to the lower jib 40 illustrated in FIG. 9. As a result, it becomes easy to perform an aftermentioned operation for position adjustment of pin holes.

(3h) As illustrated in FIG. 8C, when the boom 10 lowered in the operation (3f) is raised to the original height position (the height position in the operation (3e), etc.), the lower jib 40 is lifted up from the ground surface G.

(Upper Jib Coupling Substep)

In the upper jib coupling substep, as illustrated in FIG. 9, the upper jib 31 is coupled to the lower jib 40. In this embodiment, after preliminarily assembling the upper jib 31, i.e., after preliminarily coupling the top jib 31*a*, the intermediate jib 31*b* and the intermediate tapered jib 31*c* together, the upper jib 31 is coupled to the lower jib 40. The upper jib coupling substep comprises an arranging sub-substep, an upper jib lifting sub-substep, a rope connecting sub-substep, a rope winding sub-substep, and a pin inserting sub-substep (connector coupling sub-substep). The arranging sub-sub-step, the upper jib lifting sub-substep, the rope connecting sub-substep, the rope winding sub-substep and the pin inserting sub-substep are performed in this order. It should be noted that a sequence of these steps may be arbitrarily changed.

The arranging sub-substep is configured to set a position of the upper jib 31 with respect to the boom 10, before coupling the upper jib 31 to the lower jib 40. In the arranging sub-substep, the upper jib 31 is placed on the ground surface G, and then the upper slewing body 5*b* (see FIG. 1) is slewed to allow the boom 10 to be moved just above the upper jib 31. Thus, the lower jib 40 and the upper jib 31 of the jib 30 are arranged under the boom 10, and the boom 10, the lower jib 40 and the upper jib 31 are arranged in such a manner that respective central axes of the boom 10, the lower jib 40 and the upper jib 31 lie on a straight line, in top plan view.

In the upper jib lifting sub-substep, as illustrated in FIG. 9, the upper jib 31 is hoisted up slightly from the ground surface G by the auxiliary crane.

The rope connecting sub-substep is configured to connect a reeving rope R4 to the intermediate tapered jib 31*c* of the upper jib 31. Specifically, in the rope connecting sub-substep, the following operations (a) to (c) are performed in this order.

(a) The reeving rope R4 is pulled out from the reeving winch 7 in a direction from the boom base end side Xb1 to the boom tip side Xb2. The reeving rope R4 pulled out from the reeving winch 7 is pulled out toward the boom head 10*t* as illustrated in FIG. 9, for example, after passing through a lower side of the boom 10 (boom belly side Yb2) and then passing through an upper side of the boom 10 (boom back side Yb1), as illustrated in FIG. 1. It is to be understood that a route (wiring) of the reeving rope R4 pulled out in the direction from the boom base end side Xb1 to the boom tip side Xb2 may be appropriately changed.

(b) The reeving rope R4 pulled out as described in the operation (a) is turned back toward the boom base end side Xb1 at a position frontward of an attaching position of the reeving rope R4 to the intermediate tapered jib 31*c* (at a position on the jib base end side Xj1). Specifically, the reeving rope R4 is wrapped around a sheave provided on the boom head 10*t* in such a manner as to be turned back toward the boom base end side Xb1.

(c) A distal end of the reeving rope R4 turned back as described in the operation (b) is connected (fixed) to the intermediate tapered jib 31*c*. The distal end of the reeving rope R4 is connected, for example, to an upper region of an end of the intermediate tapered jib 31*c* on the jib base end side Xj1, i.e., a portion of an end of the intermediate tapered jib 31*c* on the jib base end side Xj1 and on the jib belly side Yj2.

In the rope winding sub-substep, the reeving rope R4 is wound by the reeving winch 7 (see FIG. 1). As a result, the upper jib 31 is moved toward the jib base end side Xj1, and the intermediate tapered jib 31*c* is moved closer to the lower jib 40. During this operation, each of the upper-side connectors 35 is engaged with a corresponding one of the lower-side connectors 50, and the position adjustment between the pin hole 35*b* of the upper-side connector 35 and the pin holes 50*b* of the lower-side connector 50 is performed by the guide bracket 37, as illustrated in FIGS. 10A and 10B and FIGS. 11A and 11B.

Details of the position adjustment are described as the following operations (d) to (e).

(d) As illustrated in 10A and 11A, an upper end of the lateral-member guide member 37*b* is brought into contact with a lower end of the distal-end lateral member 41*b*. That is, the upper end of the lateral-member guide member 37*b* supports the lower end of the distal-end lateral member 41*b*, from therebelow. Thus, a position adjustment between the pin hole 35*b* and each of the pin holes 50*b* in the jib up-down direction Yj is performed. In other words, the upper-side connector 35 is guided to a specific engagement position (relative position) where positions of the pin hole 35*b* and the pin hole 50*b* are aligned with each other in the jib up-down direction Yj. During this operation, as illustrated in FIG. 10A, the inclined portion 37*d* provided at the upper region of the distal end of the lateral-member guide member 37*b* suppress an undesirable situation where the distal end of the lateral-member guide member 37*b* is butted against the distal-end lateral member 41*b*, i.e., the distal end of the lateral-member guide member 37*b* is brought into contact with the distal-end lateral member 41*b* in opposed relation therewith.

(e) As illustrated in FIGS. 10B and 11B, the perpendicular-member guide member 37*c* is butted against the distal-end perpendicular member 41*c*, so that a position adjustment between the pin hole 35*b* and the pin hole 50*b* in the jib axis direction Xj is performed. In other words, the upper-side connector 35 is guided to a specific engagement position (relative position) where positions of the pin hole 35*b* and the pin hole 50*b* are aligned with each other in the jib axis direction Xj. As illustrated in FIG. 11B, the stepped portion 37*e* formed in the perpendicular-member guide member 37*c* makes it possible to perform a position adjustment between the pin hole 35*b* and the pin hole 50*b* in the jib lateral direction Zj, even under a condition where the lower-side connector 50 and the upper-side connector 35 are not engaged with each other, i.e., even under a condition where the plate-shaped portion 35*a* of the upper-side connector 35 is not disposed between the two plate-shaped portions 50*a* of the lower-side connector 50.

In the pin inserting sub-substep (connector coupling sub-substep), under a condition where the lower-side connector 50 and the upper-side connector 35 are engaged with each other, the pin P is inserted into the pin hole 35*b* and the pin holes 50*b*, as illustrated in FIG. 11. Through this operation, the upper-side connector 35 and the lower-side connector 50 each located on the jib belly side Yj2 in the jib 30 illustrated in FIG. 9 are coupled together. After the pin inserting sub-substep, the upper jib 31 is further hoisted up by the auxiliary crane. Then, a position adjustment and a pin coupling between the upper-side connector 35 and the lower-side connector 50 each located on the jib back side Yj1 in the jib 30 are performed.

In the above manner, the jib 30 is assembled under the boom 10. This makes it possible to suppress an assembling space for the crane 1, as compared to the case where the jib 30 is assembled only in front of the laid-down boom 10 as in assembling based on the conventional extending-type attaching method.

[Advantageous Effects]

Effects obtainable by the configuration of the crane 1 according to the above embodiment will be described below.

(Effect 1)

The crane 1 comprises: the crane body 5; the boom 10 attached to the crane body 5; the jib 30 attached to the boom head 10*t*; and the strut 20 attached to the boom head 10*t* to raise and lower the jib 20. As illustrated in FIG. 3, the lower jib 40 comprises: the lower jib frame 41, and the jib-side jib foot 43*f* provided at the end of the lower jib frame 41 on the jib base end side Xj1 and attached to the boom head 10*t*. The lower jib 40 is formed to, under the condition where the jib-side jib foot 43*f* is attached to the boom head 10*t* of the boom 10, and the lower jib frame 41 is disposed beyond the boom head 10*t* in a direction toward the boom tip side Xb2 (this condition will hereinafter be referred to as "condition B"), allow the boom head 10*t* of the boom 10 in a laid-down state to be grounded, and allow a distal end of the strut 20 in a laid-down state to be grounded, as illustrated in FIG. 2.

The lower jib 40 formed in the above manner has a length in the jib axis direction Xj, which is less than that of the conventional lower jib. Therefore, it is easy to perform a position adjustment of the lower jib 40 with respect to the boom head l Ot. Thus, it is easy to attach the lower jib 40 to the boom head 10*t*. As a result, it becomes possible to improve assemblability of the jib 30 (see FIG. 1).

As illustrated in FIG. 2, the lower jib 40 is formed to, under the condition B, allow the boom head 10*t* of the boom 10 in the laid-down state to be grounded, and allow the distal end of the front strut 20*f* in a laid-down state to be grounded. Therefore, it becomes possible to suppress an undesirable situation where the lower jib 40 hinders assembling of the strut 20. Thus, it becomes possible to improve assemblability of the strut 20. More specifically, when the boom head 10*t* is grounded as illustrated in FIG. 3, it becomes possible to suppress a height with respect to the ground surface, in terms of a position of an operation of attaching the strut 20 to the boom head 10*t*, i.e., a position of the strut mounting portion 13. Further, when the distal end of the front strut 20*f* of the strut 20 is grounded, it becomes possible to suppress a height with respect to the ground surface G, in terms of a position of an assembling operation at a distal end of the strut 20, for example, an operation of attaching the jib raising and lowering rope R1.

The lower jib 40 has a length less than that of the conventional lower jib. Therefore, it become possible to easily cause the lower jib 40 to rotate with respect to the boom head 10*t* (see FIG. 3 and FIGS. 8A to 8C). The rotation of the lower jib 40 includes the turning-over of the lower jib 40. As above, it is possible to easily cause a rotation of the lower jib 40 with respect to the boom head 10*t*, which creates a higher possibility that assembling of the jib 30 illustrated in FIG. 1 can be performed according to the following steps (a), (b) and (c). That is, it becomes easier to employ this process in the assembling of the jib 30. When the jib 30 is assembled by this process, it becomes possible to further improve assemblability of the jib 30.

(a) As illustrated in FIG. 3, the lower jib 40 is attached to the boom head 10*t* from the front side of the laid-down boom 10. This facilitates the operation of attaching the lower jib 40 to the boom head 10*t*, as compared to the conventional enfolding type.

(b) As illustrated in 8A to 8C, the lower jib 40 is turned over with respect to the boom head 10*t*.

(c) As illustrated in FIG. 9, the lower jib 40 and the upper jib 31 are coupled together under the boom 10.

(Effect 2)

As illustrated in FIG. 3, the lower jib 40 comprises the roller 65 attached to the distal end of the lower jib frame 41, i.e., an end of the lower jib frame 41 on the jib tip side Xj2.

This roller 65 allows the distal end of the lower jib 40 to be easily slidingly moved with respect to the ground surface G. Thus, it becomes possible to further facilitate turning-over of the lower jib 40 with respect to the boom head 10*t*.

(Effect 3)

As illustrated in FIG. 9, the upper jib 31 is configured to be coupled to an end of the lower jib frame 41 of the lower jib 40 on the jib tip side Xj2. The lower jib 40 comprises the lower-side connector 50 provided at the distal end of the lower jib frame 41, i.e., an end of on the lower jib frame 41 on the jib tip side Xj2, and configured to couple the lower jib frame 41 and the upper jib 31. As illustrated in FIG. 6, the lower jib 40 comprises the roller shaft 67 serving as the rotation shaft of the roller 65. The lower-side connector 50 has the pin hole 50*b* for allowing the pin P (see FIG. 11B) to be inserted thereinto. The roller shaft 67 is inserted into and attached to the pin hole 50*b*.

This configuration eliminates a need for the lower jib 40 illustrated in FIG. 5 to have a member for supporting the roller shaft 67 (except for the lower-side connector 50). Thus, it becomes possible to facilitate structural simplification and weight reduction of the lower jib 40 (jib 30).

(Effect 4)

The guide bracket 37 illustrated in FIG. 9 is configured to guide a coupling section of the jib 30. The jib 30 comprises the lower jib 40, and the upper jib 31 couplable to the lower jib 40 through the pin P (see FIG. 11B). The lower jib 40 comprises the distal-end lateral member 41*b* constituting an end of the lower jib 40 to be coupled to the intermediate tapered jib 31*c* of the upper jib 31, i.e., an end of the lower jib 40 on the jib tip side Xj2. As illustrated in FIG. 11A, the guide bracket 37 comprises the lateral-member guide member 37*b* provided at an end of the upper jib 31 to be coupled to the lower jib 40, i.e., an end of the upper jib 31 on the jib base end side Xj1. The lateral-member guide member 37*b* is configured to support the distal-end lateral member 41*b* from therebelow, under the condition where the position of the pin hole 50*b* of the lower jib 40 and the position of the pin hole 35*b* of the intermediate tapered jib 31*c* of the upper jib 31 are aligned with each other.

In this configuration, the position adjustment between the pin hole 50*b* and the pin hole 35*b* in the jib up-down direction Yj can be performed only by placing the distal-end lateral member 41*b* on the lateral-member guide member 37*b*. Thus, it becomes possible to improve efficiency of the operation of coupling the lower jib 40 and the intermediate tapered jib 31*c* of the upper jib 31.

(Effect 5)

The lower jib 40 comprises the distal-end perpendicular member 41*c* constituting the end of the lower jib 40 to be coupled to the intermediate tapered jib 31*c* of the upper jib 31, i.e., the end of the lower jib 40 on the jib tip side Xj2. As illustrated in FIG. 11B, the guide bracket 37 comprises the perpendicular-member guide member 37*c*. The perpendicular-member guide member 37*c* is configured to be brought into contact with the distal-end perpendicular member 41*c* in the jib axis direction Xj, under the condition where the position of the pin hole 50*b* of the lower jib 40 and the position of the pin hole 35*b* of the intermediate tapered jib 31*c* of the upper jib 31 are aligned with each other.

In this configuration, the position adjustment between the pin hole 50*b* and the pin hole 35*b* in the jib axis direction Xj can be performed only by causing the distal-end perpendicular member 41*c* to come into contact with (butt against) the perpendicular-member guide member 37*c*. Thus, it becomes possible to improve efficiency of the operation of coupling the lower jib 40 and the intermediate tapered jib 31*c* of the upper jib 31.

(Effect 6)

A jib coupling process in the above embodiment is a process of coupling the assembling-type jib 30 which is configured to be attached to the tip (boom head 10*t*) of the boom 10 illustrated in FIG. 9, in a raisable and lowerable manner. The jib 30 comprises the lower jib 40, and the upper jib 31 couplable to an end of the lower jib 40 on the jib tip side Xj2. The intermediate tapered jib 31*c* of the upper jib 31 comprises the guide bracket 37 for guiding, in a coupling section between the lower jib 40 and the intermediate tapered jib 31*c*, the pin hole 50*b* and the pin hole 35*b* to a position where the pin holes 50*b*, 35*b* are aligned in coaxial relation with each other. The jib coupling process comprises the arranging step, the rope connecting step, and the rope winding step. The arranging step is configured to arrange the lower jib 40 and the upper jib 31 under the boom 10, in such a manner that respective central axes of the boom 10, the lower jib 40 and the upper jib 31 lie on a straight line, in top plan view. The rope connecting step is configured to turn back the reeving rope R4 pulled out in the direction from the boom base end side Xb1 to the boom tip side Xb2, toward the boom base end side Xb1, as illustrated in FIG. 9, and attach the turned-back reeving rope R4 to the intermediate tapered jib 31*c*. The rope winding step is configured to wind the reeving rope R4 using the reeving winch 7 (see FIG. 1) to move the upper jib 31 to come close to the lower jib 40, while aligning the position of the pin hole 50*b* of the lower jib 40 with the position of the pin hole 35*b* of the intermediate tapered jib 31*c* by using the guide bracket 37, as illustrated in FIGS. 10A to 11B.

In the rope winding step of the jib coupling method, the reeving rope R4 is wound by the reeving winch 7 illustrated in FIG. 1 to move the upper jib 31 to come close to the lower jib 40, while aligning the position of the pin hole 50*b* with the position of the pin hole 35*b* by using the guide bracket 37, as illustrated in FIGS. 10A to 11B. Therefore, the position adjustment between the pin hole 50*b* and the pin hole 35*b* can be performed only by winding the reeving rope R4 (see FIG. 1). Thus, it becomes possible to improve efficiency of the operation of coupling the lower jib 40 and the intermediate tapered jib 31*c* of the upper jib 31.

[First Modified Embodiment]

Figure 12A:
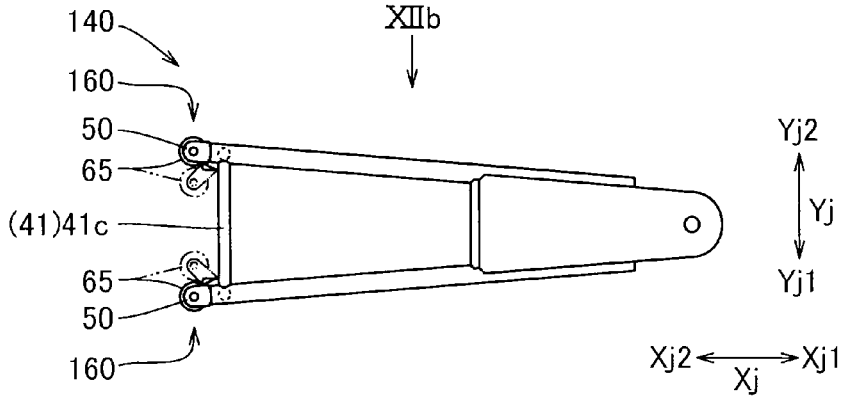
FIG. 12A is a schematic diagram of a lower jib 140 provided with a roller section 160 in a first modified embodiment, when viewed in a lateral direction of a jib.
Figure 12B:
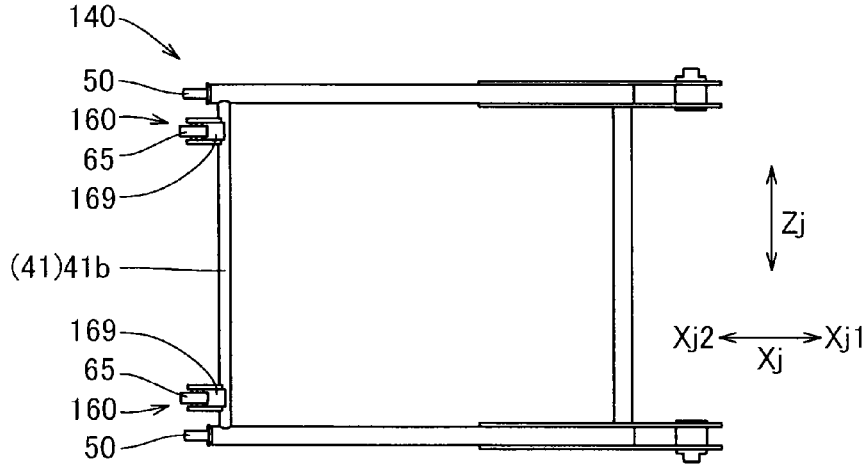
FIG. 12B is a schematic diagram of the lower jib 140, when viewed from a direction indicated by the arrow XIIb in FIG. 12A.
Figure 12C:
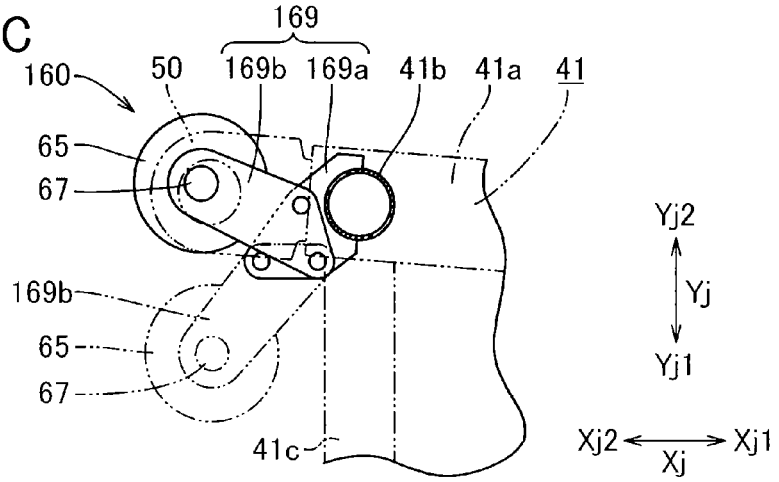
FIG. 12C is an enlarged view of an area around the roller section 160 illustrated in FIG. 12A.

With reference to FIGS. 12A to 12C, regarding a roller unit 160 of a lower jib 140 in a first modified embodiment, a difference from the roller unit 60 of the lower jib 40 illustrated in FIGS. 4 and 5 will be described. In the roller unit 60 illustrated in FIGS. 4, the roller 65 is attached to the lower-side connector 50, and the roller shaft 67 is fixed with respect to the lower jib frame 41. Differently, in the roller unit 160 illustrated in FIG. 12A, a roller 65 and a roller shaft 67 are configured to be movable between a protruding position where they protrude outwardly from the lower jib frame 41, and a retracted position where they are retracted from the protruding position toward the lower jib frame 41. The above difference will be further described. A direction of the lower jib 140 illustrated in FIG. 12A is approximately identical to that of the lower jib 40 illustrated in FIG. 9, and is in left-right reversal relation to that of the lower jib 40 illustrated in FIG. 4.

As illustrated in FIG. 12C, the roller unit 160 comprises the roller 65, the roller shaft 67 and a roller supporting device 169.

The roller supporting device 169 supports the roller 65 in such a manner that the roller 65 is movable between a protruding position where the roller 65 protrudes outwardly from the distal end of the lower jib frame 41, and a retracted position where the roller 65 is retracted from the protruding position toward the lower jib frame 41. The roller supporting device 169 is configured, when or after the lower jib frame 41 and the upper jib 31 are coupled together, as illustrated in FIGS. 10A and 11A, to allow the roller 65 to be moved to the retracted position so as to keep the roller 65 from interfering with other member, as illustrated in FIG. 12C. For example, the other member includes the pin P illustrated in FIG. 11B, the guide bracket 37, the base-end perpendicular member 33*c*, and the base-end lateral member 33*b*. The roller supporting device 169 will be described below, based on one example where it is configured to keep the roller 65 from interfering with the pin P (see FIG. 11B), as illustrated in FIG. 12C.

For example, this type of roller supporting device 169 comprises a frame-side support portion 169*a*, and a roller-side support portion 169*b*. The frame-side support portion 169*a* is fixed to the lower jib frame 41. For example, it is fixed to the distal-end lateral member 41*b*. Alternatively, the frame-side support portion 169*a* may be fixed to the distal-end perpendicular member 41*c*. As illustrated in FIG. 12B, the frame-side support portion 169*a* is disposed adjacent to the lower-side connector 50. For example, it is disposed inward of the lower-side connector 50 in the jib lateral direction Zj. As illustrated in FIG. 12C, the roller-side support portion 169*b* couples the frame-side support portion 169*a* and the roller 65 (roller shaft 67) therethrough. The roller-side support portion 169*b* is attached to the frame-side support portion 169*a* in a movable manner, e.g., in a rotatable manner. The roller-side support portion 169*b* is formed with a plurality of pin holes, and fixed to the frame-side support portion 169*a* through pins. In FIGS. 12A and 12C, the roller 65 and the roller-side support portion 169*b* at the retracted position are indicated by the two-dot chain line. Further, in FIG. 12C, the main member 41*a*, the distal-end lateral member 41*b* and the lower-side connector 50 are indicated by the two-dot chain lines.

(Effect 7)

An effect of the lower jib 140 equipped with the roller supporting device 169 will be described below. The lower jib 140 comprises the roller supporting device 169 supporting the roller 65 in such a manner as to allow the roller 65 to be retracted toward the lower jib frame 41. The roller supporting device 169 is configured, when or after the lower jib frame 41 and the upper jib 31 (see FIG. 9) are coupled together, to allow the roller 65 to be moved to the retracted position so as to keep the roller 65 from interfering with other member.

The roller supporting device 169 can couple the lower jib 140 and the upper jib 31 (see FIG. 9) therethrough, while keeping the roller 65 in the attached state with respect to the lower jib 140.

[Second Modified Embodiment]

Figure 13A:
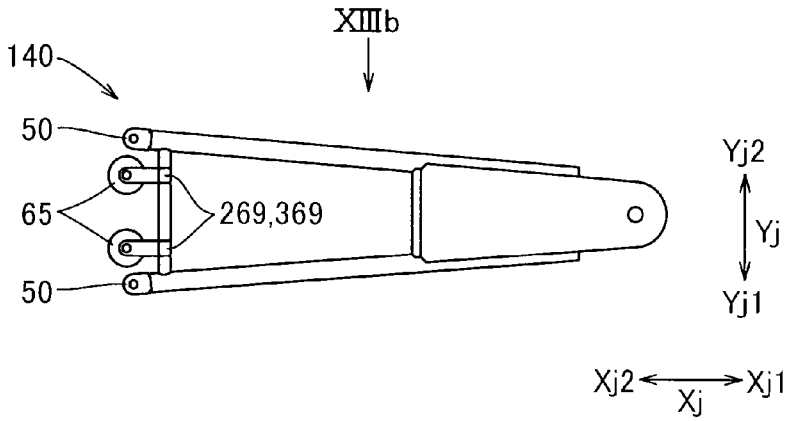
FIG. 13A is a schematic diagram corresponding to FIG. 12A, wherein illustrates a lower jib 140 in a second modified embodiment.
Figure 13B:
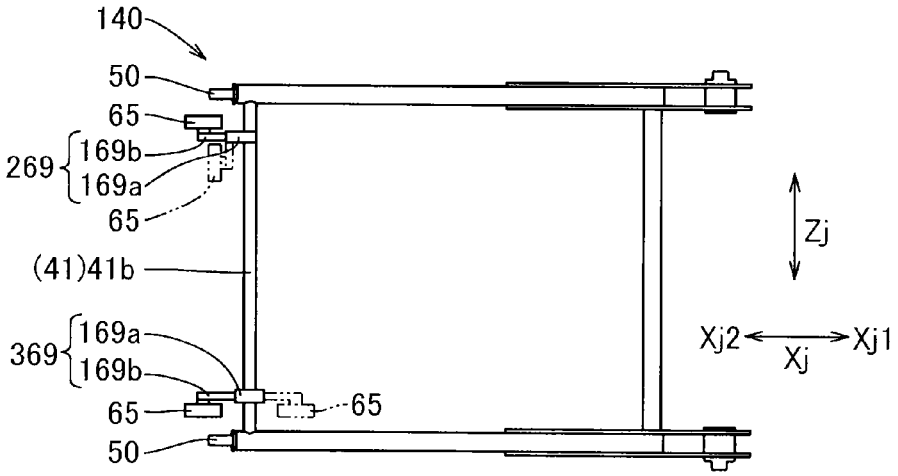
FIG. 13B is a schematic diagram corresponding to FIG. 12B, wherein illustrates the lower jib 140 in the second modified embodiment.

With reference to FIGS. 13A and 13B, regarding two type of roller supporting devices 269, 369 in a second modified embodiment, a difference from the roller supporting device 169 illustrated in FIGS. 12A to 12C will be described. Specifically, a difference in terms of a movable direction and an attaching position of the roller 65 will be described mainly.

The roller supporting device 269 supports the roller 65 in such a manner as to allow the roller 65 to be moved with respect to the lower jib frame 41 in the jib axis direction Xj. The roller supporting device 269 is attached to the distal-end lateral member 41*b*. For example, the roller supporting device 269 comprises a roller side support portion 169*b* bendable with respect to the frame-side support portion 169*a* in the jib lateral direction Zj.

For example, the roller supporting device 369 comprises a roller side support portion 169*b* rotatable sideways and rotatable 180-degree with respect to a frame-side support portion 169*a* in the jib axis direction Xj. As illustrated in FIG. 13B, each of the roller supporting devices 269, 369 may be attached to the distal-end perpendicular member 41*c*. Further, each of the roller supporting devices 269, 369 may support the roller 65 in such a manner as to allow the roller 65 to be moved in the jib up-down direction Yj.

[Other Modifications]

It is to be understood that various modifications may be made in the above embodiment.

Although the above embodiment has been made based on an example where the boom head 10*t* and the lower jib 40 are designed for the enfolding support type, the boom head 10*t* and the lower jib 40 may be designed for the jib offset type.

Alternatively, for example, the boom head 10*t* and the lower jib 40 may be designed for the extending type. In a boom head 10*t* for the extending type, the boom-side jib foot 15*f* is disposed at the same position as that in a boom head for the enfolding support type, without providing the boom-side support portion 15*s*.

In the above embodiment, the guide bracket 37 is provided in the intermediate tapered jib 31*c* of the upper jib 31, as illustrated in FIG. 9. Alternatively, the guide bracket 37 may be provided in the lower jib 40.

In the above embodiment, the guide bracket 37 is provided in the connection section between the lower jib 40 and the intermediate tapered jib 31*c*. Alternatively, the guide bracket 37 may be provided in either one of the following regions (a) to (c).

(a) A connection section of the jib 30 other than the connection section between the lower jib 40 and the intermediate tapered jib 31*c*. For example, such a connection section may include a connection section between the intermediate tapered jib 31*c* and the intermediate jib 31*b* illustrated in FIG. 1.

(b) A connection section of the boom 10. For example, such a coupling section may include a connection section between the top boom 10*c* and the intermediate boom 10*b*, and a connection section between the intermediate boom 10*b* and the lower boom 10*a*.

(c) A connection section of the strut 20. For example, such a coupling section may include a connection section between a base end-side member of the front strut 20*f*, and a distal end-side member of the front strut 20*f*.

Figure 14:
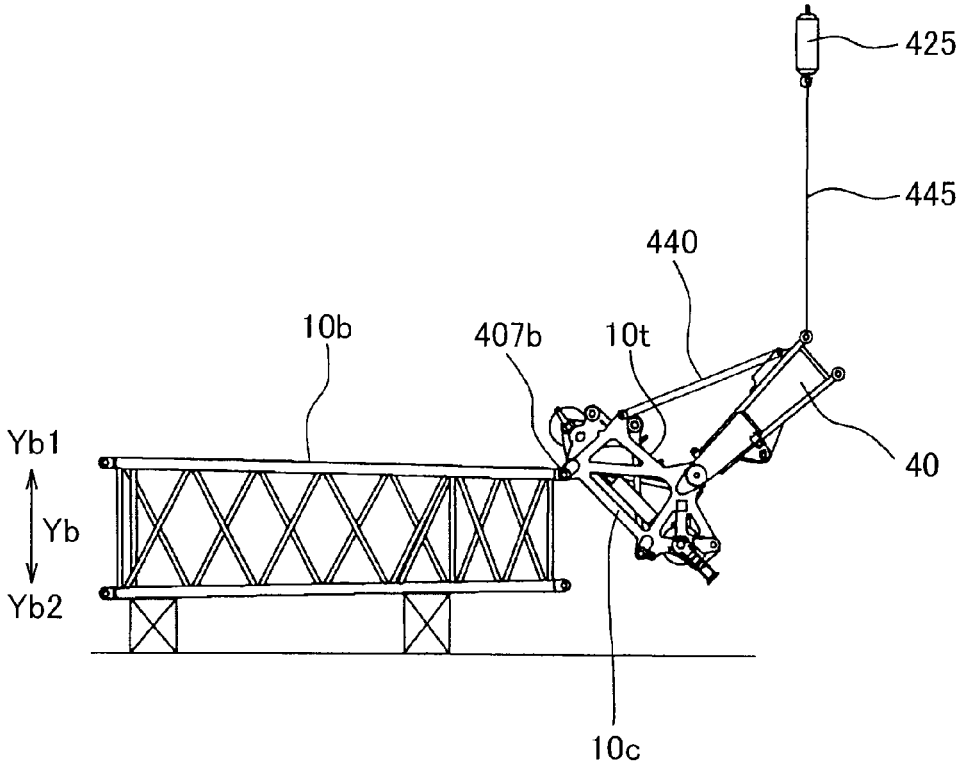
FIG. 14 is a side view illustrating one step in a process of disassembling and transporting a top boom 10*c* (boom head) of a crane.

In advance of transportation of the crane, the boom 10 is disassembled and transported. In this case, under the condition where the top boom 10*c* (boom head) and the lower jib 40 are coupled together, the top boom 10*c* may be detached from the intermediate boom 10*b*, and transported by a trailer loaded with the detached top boom 10*c* and the lower jib 40 formed in an integral structure. FIG. 14 illustrates a step during a course of detaching the top boom 10*c* from the intermediate boom 10*b* in advance such transportation.

When the top boom 10*c* is detached from the intermediate boom 10*b*, a coupling section 407*b* between the intermediate boom 10*b* and the top boom 10*c*, on the boom back side Yb1, is maintained in a pin-joined state, whereas a pin-joined state of a coupling section between the intermediate boom 10*b* and the top boom 10*c*, on the boom belly side Yb2 is released. Then, a portion of the lower jib 40 on the side of the distal end thereof is hoisted up using a hanging hook 425 of an auxiliary crane via a rope 445, and the top boom 10*c* and the lower jib 40 is coupled together by a rod-shaped coupling member 440. In this way, the top boom 10*c* and the lower jib 40 are coupled together by the coupling member 440, so that a relative position between the top boom 10*c* and the lower jib 40 is fixed so as to keep the lower jib 40 from rotating with respect to the top boom 10*c*. Then, the distal end of the lower jib 40 is further hoisted up by the auxiliary crane, so that the lower jib 40 and the top boom 10*c* integrally rotate with respect to the intermediate boom 10*b*, about the pin of the coupling section 407*b*, and set in a state illustrated in FIG. 14. Then, the distal end of the lower jib 40 is further hoisted up to cause the lower jib 40 and the top boom 10*c* to rotate until the lower jib 40 has a posture where it extends in an approximately vertical direction. Then, the pin-joined state of the coupling section 407*b* is released to separate the top boom 10*c* from the intermediate boom 10*b*, and subsequently the lower jib 40 and the top boom 10*c* are hoisted up and put on a trailer by using the auxiliary crane hanging the lower jib 40.

[Outline of the Embodiment]

The above embodiment can be outlined as follows.

A crane according to the above embodiment comprises: a crane body; a boom attached to the crane body in a raisable and lowerable manner; a luffing jib attached to a head of the boom in a raisable and lowerable manner; and a strut attached to the head of the boom in a raisable and lowerable manner, and configured to raise and lower the luffing jib. The luffing jib comprises: a lower jib making up a first portion of the luffing jib, wherein the first portion extends over a specific range from a base end of the luffing jib toward a tip of the luffing jib and wherein the lower jib is attached to the head of the boom in a raisable and lowerable manner, at a position located below an attaching position of a base end of the strut to the head of the boom in a state in which the boom is lowered and laid down; and an upper jib making up a second portion of the luffing jib, the second portion positioned between the tip of the luffing jib and the lower jib, wherein the upper jib is coupled to the lower jib in such a manner as to be separable from the lower jib. The lower jib is attached to the head of the boom to have a laid-down posture at a position between the boom and the strut when the upper jib is separated from the lower jib, when the boom is lowered and laid down to allow the head of the boom to come into contact with the ground and when the strut is lowered and laid down to allow a distal end of the strut to come into contact with the ground. The lower jib has a length which causes no interference with the strut when the lower jib has the laid-down posture at the position between the boom and the strut.

Preferably, in the above crane, the lower jib comprises a roller which supports an end of the lower jib on a side opposite to the head of the boom on a ground surface while being rollingly movable on the ground surface, under the condition where the upper jib is separated from the lower jib.

More preferably, in this case, the lower jib comprises: a lower-side connector provided at the end of the lower jib on the side opposite to the head of the boom; and a roller shaft which is a rotation shaft of the roller, wherein the lower-side connector has a pin hole capable of allowing the roller shaft, and a pin for coupling the upper jib to the lower-side connector, to be selectively inserted thereinto.

More preferably, in the crane where the lower jib has the roller, the lower jib comprises: a jib foot provided at a base end of the lower jib and attached to the head of the boom; a frame extending from the jib foot toward the side opposite to the head of the boom; and a roller supporting device provided at a distal end of the frame, which is an end of the frame on a side opposite to the jib foot, to support the roller in such a manner as to allow the roller to move between a protruding position where the roller protrudes outwardly from the distal end of the frame and a retracted position where the roller is retracted from the protruding position toward the frame.

Preferably, in the above crane, the lower jib comprises a lower-side connector provided at the end of the lower jib on the side opposite to the head of the boom; and the upper jib comprises an upper-side connector provided at an end of the upper jib on a side coupled to the lower jib, and coupled to the lower-side connector, wherein each of the lower-side connector and the upper-side connector has a pin hole, so that the lower-side connector and the upper-side connector are coupled together by inserting a pin into the pin holes of the lower-side and upper-side connectors, and wherein a first jib as one of the lower jib and the upper jib is provided with a guide bracket configured to guide the lower-side connector and the upper-side connector to a specific relative position where positions of respective pin holes of the lower-side and upper-side connectors are aligned with each other.

More preferably, in this case, a second jib as the other of the lower jib and the upper jib comprises a lateral member provided at an end of the second jib on the side of the first jib to extend in a width direction of the second jib, wherein the guide bracket comprises a lateral-member guide member provided at an end of the first jib on the side of the second jib, and configured to support the lateral member from therebelow, under a condition where the position of the pin hole of the lower-side connector is aligned with the position of the pin hole of the upper-side connector.

More preferably, in the crane where the guide bracket is provided in the first jib, a second jib as the other of the lower jib and the upper jib comprises a perpendicular member provided at an end of the second jib on the side of the first jib to extend in a direction perpendicular to a width direction and an axial direction of the second jib, wherein the guide bracket comprises a perpendicular-member guide member provided at an end of the first jib on the side of the second jib, and configured to be brought into contact with the perpendicular member under a condition where the position of the pin hole of the lower-side connector is aligned with the position of the pin hole of the upper-side connector.

A crane assembling method according to the above embodiment comprises: a preparation step of preparing the crane body while providing the crane body with a reeving winch for winding and unwinding a reeving rope; a boom attaching step of attaching the boom to the crane body; a strut attaching step of attaching the strut to the head of the boom; and a jib attaching and assembling step of attaching the luffing jib to the head of the boom, and assembling the luffing jib. The jib attaching and assembling step includes: a lower jib attaching substep of attaching the lower jib to the head of the boom; an arranging substep of arranging the lower jib and the upper jib under the boom in such a manner that a central axis of the boom, a central axis of the lower jib and a central axis of the upper jib lie on a straight line, in top plan view; a rope connecting substep of: pulling out the reeving rope from the reeving winch in a direction from a base end of the boom to a tip of the boom; wrapping the pulled-out reeving rope around the head of the boom to turn back the pulled-out reeving rope toward the base end of the boom; and connecting the turned-back reeving rope to the upper jib; a rope winding substep of winding the reeving rope using the reeving winch to move the upper jib to come close to the lower jib so as to allow the upper-side connector to be engaged with the lower-side connector; and a connector coupling substep of inserting a pin into respective pin holes of the lower-side and upper-side connectors, under a condition where the upper-side connector is engaged with the lower-side connector, to connect the lower-side and upper-side connectors together, wherein the rope winding substep includes guiding the upper-side connector, by the guide bracket, to an engagement position where the upper-side connector is engaged with the lower-side connector and where the position of the pin hole of the upper-side connector is aligned with the position of the pin hole of the lower-side connector.

This application is based on Japanese Patent applications No. 2012-211945 and No. 2012-211946 filed in Japan Patent Office on Sep. 26, 2012, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A crane comprising:

a crane body;

a boom attached to the crane body in a raisable and lowerable manner, the boom having two opposite ends, one end of the two opposite ends being a base end attached to the crane body, the other end of the two opposite ends being a head which is a distal end of the boom;

a luffing jib which is a structural body for suspending a load through a wire rope and a hook, the luffing jib being attached to the head of the boom in a raisable and lowerable manner; and a strut attached to the head of the boom in a raisable and lowerable manner, and configured to raise and lower the luffing jib, the strut having a base end attached to the head of the boom;

wherein the luffing jib comprises: a lower jib making up a first portion of the luffing jib, the first portion extending over a specific range from a base end of the luffing jib toward a tip of the luffing jib, the lower jib being attached to the head of the boom in a raisable and lowerable manner, at a position located below an attaching position of a base end of the strut to the head of the boom in a state in which the boom is lowered and laid down; and an upper jib making up a second portion of the luffing jib, the second portion positioned between the tip of the luffing jib and the lower jib, the upper jib being coupled to the lower jib in such a manner as to be separable from the lower jib, and wherein the lower jib is attached to the head of the boom to have a laid-down posture at a position between the boom and the strut when the upper jib is separated from the lower jib, when the boom is lowered and laid down to allow the head of the boom to come into contact with the ground and when the strut is lowered and laid down to allow a distal end of the strut to come into contact with the ground, the lower jib having a length which causes no interference with the strut when the lower jib has the laid-down posture at the position between the boom and the strut.

2. The crane as defined in claim 1, wherein the lower jib comprises a roller which supports an end of the lower jib on a side opposite to the head of the boom on a ground surface while being rollingly movable on the ground surface, under the condition where the upper jib is separated from the lower jib.

3. The crane as defined in claim 2, wherein the lower jib comprises:

a lower-side connector provided at the end of the lower jib on the side opposite to the head of the boom; and a roller shaft which is a rotation shaft of the roller, and wherein the lower-side connector has a pin hole capable of allowing the roller shaft, and a pin for coupling the upper jib to the lower-side connector, to be selectively inserted thereinto.

4. The crane as defined in claim 2, wherein the lower jib comprises:

a jib foot provided at a base end of the lower jib and attached to the head of the boom;

a frame extending from the jib foot toward the side opposite to the head of the boom; and a roller supporting device provided at a distal end of the frame, which is an end of the frame on a side opposite to the jib foot, to support the roller in such a manner as to allow the roller to move between a protruding position where the roller protrudes outwardly from the distal end of the frame and a retracted position where the roller is retracted from the protruding position toward the frame.

5. The crane as defined in claim 1, wherein:

the lower jib comprises a lower-side connector provided at the end of the lower jib on the side opposite to the head of the boom; and the upper jib comprises an upper-side connector provided at an end of the upper jib on a side coupled to the lower jib, and coupled to the lower-side connector, and wherein each of the lower-side connector and the upper-side connector has a pin hole, so that the lower-side connector and the upper-side connector are coupled together by inserting a pin into the pin holes of the lower-side and upper-side connectors, and wherein a first jib as one of the lower jib and the upper jib is provided with a guide bracket for guiding the lower-side connector and the upper-side connector to a specific relative position where positions of respective pin holes of the lower-side and upper-side connectors are aligned with each other.

6. The crane as defined in claim 5, wherein a second jib as the other of the lower jib and the upper jib comprises a lateral member provided at an end of the second jib on the side of the first jib to extend in a width direction of the second jib, and wherein the guide bracket comprises a lateral-member guide member provided at an end of the first jib on the side of the second jib, to support the lateral member from therebelow, under a condition where the position of the pin hole of the lower-side connector is aligned with the position of the pin hole of the upper-side connector.

7. The crane as defined in claim 5, wherein a second jib as the other of the lower jib and the upper jib comprises a perpendicular member provided at an end of the second jib on the side of the first jib to extend in a direction perpendicular to a width direction and an axial direction of the second jib, and wherein the guide bracket comprises a perpendicular-member guide member provided at an end of the first jib on the side of the second jib, and configured to be brought into contact with the perpendicular member under a condition where the position of the pin hole of the lower-side connector is aligned with the position of the pin hole of the upper-side connector.

8. A method of assembling the crane as defined in claim 5, comprising:

a preparation step of preparing the crane body while providing the crane body with a reeving winch for winding and unwinding a reeving rope;

a boom attaching step of attaching the boom to the crane body;

a strut attaching step of attaching the strut to the head of the boom; and a jib attaching and assembling step of attaching the luffing jib to the head of the boom, and assembling the luffing jib, wherein the jib attaching and assembling step includes:

a lower jib attaching substep of attaching the lower jib to the head of the boom;

an arranging substep of arranging the lower jib and the upper jib under the boom in such a manner that a central axis of the boom, a central axis of the lower jib and a central axis of the upper jib lie on a straight line, in top plan view;

a rope connecting substep of: pulling out the reeving rope from the reeving winch in a direction from a base end of the boom to a tip of the boom; wrapping the pulled-out reeving rope around the head of the boom to turn back the pulled-out reeving rope toward the base end of the boom; and connecting the turned-back reeving rope to the upper jib;

a rope winding substep of winding the reeving rope using the reeving winch to move the upper jib to come close to the lower jib so as to allow the upper-side connector to be engaged with the lower-side connector; and a connector coupling substep of inserting the pin into respective pin holes of the lower-side and upper-side connectors, under a condition where the upper-side connector is engaged with the lower-side connector, to connect the lower-side and upper-side connectors together, wherein the rope winding substep includes guiding the upper-side connector, by the guide bracket, to an engagement position where the upper-side connector is engaged with the lower-side connector and where the position of the pin hole of the upper-side connector is aligned with the position of the pin hole of the lower-side connector.

* * * * *